US006075513A

United States Patent [19]

Reddy et al.

[11] Patent Number: 6,075,513

[45] **Date of Patent: *Jun. 13, 2000**

[54] METHOD AND APPARATUS FOR AUTOMATICALLY MAINTAINING A PREDETERMINED IMAGE QUALITY IN A DISPLAY SYSTEM

[75] Inventors: Dayakar C. Reddy; Modugu V. Reddy, both of San Jose; Sriram Ramamurthy, Fremont, all of Calif.

[73] Assignee: Cirrus Logic, Inc., Fremont, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/624,188

[22] Filed: Mar. 28, 1996

Related U.S. Application Data

[63] Continuation of application No. 08/214,370, Mar. 17, 1994, abandoned.

[51] Int. Cl.[7] ..... G09G 3/36

[52] U.S. Cl. ..... 345/112; 345/117; 345/214; 345/204

[58] Field of Search ..... 345/101, 102, 345/112, 204, 214, 200, 192, 193, 87, 213; 382/300; 395/200

[56] References Cited

U.S. PATENT DOCUMENTS

| | | | |
|---|---|---|---|
| 3,789,386 | 1/1974 | Itoh | 345/138 |
| 3,955,187 | 5/1976 | Bigelow | 340/324 M |
| 4,023,165 | 5/1977 | Holt et al. | 345/138 |
| 4,165,506 | 8/1979 | Brands | 345/200 |
| 4,390,874 | 6/1983 | Woodside et al. | 340/812 |
| 4,873,516 | 10/1989 | Castleberry | 340/784 |
| 4,990,904 | 2/1991 | Zenda | 345/192 |
| 5,010,326 | 4/1991 | Yamazaki et al. | 340/784 |
| 5,027,111 | 6/1991 | Davis et al. | 345/101 |
| 5,029,982 | 7/1991 | Nash | 345/101 |
| 5,033,822 | 7/1991 | Ooki et al. | 350/331 T |
| 5,088,806 | 2/1992 | McCartney | 345/101 |
| 5,155,477 | 10/1992 | Shirochi | 345/87 |
| 5,251,301 | 10/1993 | Cook | 395/200 |
| 5,398,042 | 3/1995 | Hughes | 345/101 |
| 5,550,556 | 8/1996 | Wu et al. | 345/213 |
| 5,570,436 | 10/1996 | Fukushima et al. | 382/300 |

*Primary Examiner*—Kent Chang
*Attorney, Agent, or Firm*—Robert Platt Bell

[57] ABSTRACT

A digital system provides command data to a display system during the display time period such that minimal image degradation occurs. The digital system includes a CPU coupled to a graphics controller coupled to a display system via a cable. The display system includes an intelligent display driver controller (IDDC), driver circuits, display screen, and possibly sensors. The IDDC operates on image data and instructs the driver circuits to display an image on the display screen. Operating condition changes measured by transducers may result in a degradation in image quality unless a response is made. The digital system may automatically respond to operating condition changes to maintain a predetermined image quality level. Alternatively a user's request may change the image quality. In either case the CPU is interrupted and it provides one or more control sets of command data interspersed within the image data transparently to the graphics controller. The IDDC receives one or more control sets from the graphics controller and may store a control set to adjust the control over the driver circuits thereby preserving the image quality. Changes to hardware and software are minimized to reduce the costs of adding these improvements.

19 Claims, 13 Drawing Sheets

831
833
832
902
901
900
11
FRAME 11
812
FRAME 12
813
FRAME 13
910
FRAME (N-1)
911
FRAME (N)
912
FRAME (N+1)

831
11
FRAME 11
932
922
FRAME 12
933
923
FRAME 13
934
924
FRAME (N-1)
935
925
FRAME (N)
926
FRAME (N+1)

831
11
FRAME 11
942
927
FRAME 12
943
928
FRAME 13
944
949
FRAME (N-1)
945
950
FRAME (N)
951
FRAME (N+1)

CONTROL SET NUMBER FRAME
CONTROL SET DATA FRAMES
NORMAL IMAGE FRAME

METHOD AND APPARATUS FOR AUTOMATICALLY MAINTAINING A PREDETERMINED IMAGE QUALITY IN A DISPLAY SYSTEM

This is a Continuation of application Ser. No. 08/214,370 filed on Mar. 17, 1994, now abandoned.

FIELD OF THE INVENTION

This invention relates to the field of on-board display driver controllers. More particularly, this invention relates to a system for providing non-display signals or control data to the on-board display driver controller during the display period.

BACKGROUND OF THE INVENTION

FIG. 1 shows a block diagram of a conventional digital system such as a computer or multimedia system 150 which includes a graphics controller 126 that can support a panel display 132 or an external cathode ray tube (CRT) display 103. It is understood that a typical digital system usually will only include a single display device. However, it is possible to include more than one display in a single system, wherein all of the displays are supported by the graphics controller 126.

In the computer or multimedia system 150 illustrated in FIG. 1, a main control printed circuit board 120, commonly known as the 'motherboard', includes, amongst other devices, a central processing unit (CPU) 122 that is coupled to an address/data bus 124. A graphics controller 126, such as a VGA controller, is also coupled to the bus 124. Once the graphics controller 126 has processed the information necessary for forming an image, the information is coupled to a display bus 128 and then to a first cable connector 130 for supporting the panel display 130.

The motherboard 120 is coupled to the display system 132 via a standard cable 134. The standard cable 134 may include a plurality of pixel data signal lines. The standard cable 134 typically includes 3, 4, 6, 8, 9, 12, 15, 16, 18 or 24 pixel data signal lines. Multiple standard cables 134 may be coupled between the motherboard 120 and the display 132, each having N pixel data signal lines, allowing more pixels to be carried across the cable at one time. Other control signal lines including vertical sync, horizontal sync, pixel clock and data enable lines may be included within the standard cable 134 as well. Power and ground lines may be included within the standard cable 134 as well. If the pixel display 132 is not attached to the computer or multimedia system 150, the power supply lines may be provided separately to the panel display or by a self contained battery source. Exemplary control signal lines are designated as the lines 152, 153 and 154. The standard cable 134 is coupled to the display system 132 via a second cable connector 136. The information received at the cable connector 136 is coupled to the row driver devices (RD1–RDn) 105A–105N (105X) as well as the column driver devices (CD1–CDn) 142A–142N (142X) of the panel display 132. Through the pixel data bus 144, the pixel data is properly sent to each column driver 142X as each row is scanned via row drivers 105X. Techniques of how various panels are scanned is well known in the art and will not be further explained herein. An exemplary display system updates the screen information once every 16 milliseconds. One entire screen image is conventionally called a frame.

An optional CRT display 103 can be coupled external to the computer or multimedia system 150. The CRT display 103 is coupled to the computer or multimedia system 150 and motherboard 120 through a first connector 101, a cable 164, and a second connector 104. The graphics controller 126 generates and drives the analog RGB or digital pixel signals to the CRT display 103 via the bus 123. The analog RGB or digital pixel signals are received across the cable 164 by a CRT driver board 106 which drives the CRT electron guns 107 via a cable 121. Cable 164 may be one of a plurality of cable types having appropriate connectors 101 and 104 to transmit data from the motherboard 120 to the CRT display 103.

In a conventional color display system, the image data necessary to display a single pixel may include 24 bits total, 8 bits each for red, green, and blue. Alternatively, 18 bits total may be used including 6 bits each for the colors red, green and blue as well as other numbers defining a pixel data word including monochrome pixel data words. Video memory 172 is loaded with the data necessary for the graphics controller 126 to instruct the panel display 132 to draw each pixel. Presently, a pixel data word may be sent over the standard cable 134 one pixel at a time in parallel groups of 24 bits or 18 bits, as the case may be, onto pixel data bus 144. Future systems may transfer more than one pixel data word at a time across the standard cable 134, using multiple cables, such that two or more pixels will be transmitted simultaneously.

The column drivers 142X and row drivers 105X are configured to excite predetermined portions of a display screen in one of several known ways. The panel 112 can be a passive matrix LCD display, active matrix LCD display or other type of panel. Optionally a CRT display 103 may be driven alone by the graphics controller 126 as part of a desk-top computer or simultaneously with the panel display 132 that may be a part of a computer or multimedia system 150. Depending upon the display screen being used, appropriate display circuits will be selected. It should be apparent to one of ordinary skill in the art how the column driver circuits 142X and row driver circuits 105X are activated to excite the entire array of pixels within the panel 112 to form a complete image.

As display technology has progressed, skilled practitioners have learned that the quality of a displayed image can change with a variety of parameters including temperature, display voltage linearity and intrinsic properties of the display screen. Because responses to variations in these and other such parameters are known, a system can be optimized to operate for a predetermined known parameter set. Unfortunately, these parameters can change over periods of time as well as environmental conditions. For example, as the time of day changes, the operating temperature of a display system may change. For a computer or multimedia system, the power supply voltage can sag as the battery charge decays between charging periods. It is desirable to compensate for poor image quality of the display, that may be caused by a change in these panel parameters.

Due to market conditions, it is desirable to keep the interface architecture between a CPU and a display fixed as much as possible. It is also desirable to keep the software that controls the interface fixed as much as possible. It is particularly desirable to keep the graphics controller integrated circuit 126 and the video bios fixed, yet improve the controllability of the panel display 132 and the CRT display 103. Typical customers and applications demand that the various components of a personal computer such as a so-called "IBM PC clone" be plug compatible. In other words, changes to the equipment provided by one manufacturer which make a product no longer compatible with equipment manufactured by others, will not readily gain market acceptance. It is therefore desirable to maintain compatibility in the hardware components of a system. For example, it is desirable that any compatible display 132 may be coupled to the motherboard 120 by a standard cable 134.

It is desirable that a display system be manually or automatically modified such that the display image can be improved as operating conditions change. It is further desirable that a system designed to provide these advantages, be compatible with existing software and hardware components such that few changes are required to the existing interface architecture.

SUMMARY OF THE INVENTION

A digital system includes a CPU that is coupled to a display controller which in turn is coupled to a display system via a cable. The display system includes an intelligent display driver controller (IDDC), a plurality of driver circuits and a display screen. The intelligent display driver controller receives instructions and data (display information) from the display controller over the cable. The intelligent display driver controller operates on display information, transforms the display information based on current conditions and provides appropriate instructions to appropriate ones of the plurality of driver circuits for forming an image on a display screen.

The display system may also include one or more transducers and/or sensors which measure operating conditions. Changes in the measured operating conditions will result in a degradation in display image quality unless a response is made. The digital system may be configured to automatically respond to changes in the measured operating conditions in order to maintain a predetermined level of image quality. Alternatively a user may select, via operating system software or application software, that the screen parameters be updated to improve the quality of the display. In the case of software selection, no sensors may be necessary to sense changing environmental conditions.

Three techniques are taught for providing control information to a display. A first technique includes additional control signal lines and/or cables coupled between the display system and the CPU or graphics controller. Upon receiving indication of a change in operating conditions, the display system transmits information regarding the new conditions to the CPU or graphics controller. In response, the CPU or graphics controller transmits a new set of information (hereinafter control set) over the additional signal lines to the intelligent display driver controller to enable it to transform display data to suit the changed conditions and in turn control the driver circuits suitably. In the preferred embodiment a control set includes approximately 2,000 bytes of control information.

A second technique includes a large PROM coupled to the intelligent display driver controller. The PROM contains a plurality of control sets. Each control set provides the necessary information to allow the intelligent display driver controller to transform display data and control the driver circuits for a particular operating condition. The intelligent display driver controller includes sufficient digital control circuitry to select an appropriate one of the control sets depending upon information received from transducers/sensors or from the user via software.

A third technique teaches the preferred embodiment and does not require the expense of a large PROM, nor the overhead of many additional signal lines or cables. In one case it requires the addition of one signal line within the interface cable, corresponding connectors and additional application software tied to ROM BIOS. In another case only application software tied to ROM BIOS is necessary with no changes in the cable and corresponding connectors. The third technique operates by replacing a pixel word, within the stream of pixel data bits, normally sent to the screen, with a signature word, a control set number or a control set word.

In the first case of the third technique when the panel sensors sense a change in operating conditions of the display system, an interrupt signal is transmitted to the CPU over an added interrupt signal line within the display cable. In the second case, a computer user requests a change in the screen parameters via software which also interrupts the CPU to update the parameters. In the second case no additional cabling hardware is required. In either case, upon receiving an interrupt signal from the display system or user, the CPU provides, in sequence, a plurality of data bytes across a number of frames representing a signature word, control set number, or a control set word transparently to the graphics controller and into video memory. The graphics controller, ignorant that a signature word, control set number or control set word may be within an image, reads the frame information from video memory and provides the data for each frame, as usual, across a cable to the intelligent display driver controller. The intelligent display driver controller, looks for the signature, detects the signature over a number of frames, checks the control set number and may then capture one of a plurality of control sets over an additional set of frames.

Alternate protocols for sending data from the digital system to the digital display over the cable during the display time are discussed. The preferred protocol for sending control set data is to precede the control set by a signature and a control set number. The intelligent display driver controller analyzes the control set number and determines if the number ranges within the default, forced, or desired values. If default or forced, the intelligent display driver controller automatically receives the following control set. If the number is within the desired range the intelligent display driver controller looks to see if the number matches what it wants. If so than the control set is received. If not than the control set is ignored. The forced or default values can be generated externally to the display system via automatic or user selectable means. A second protocol is where a signature precedes a series of control sets in a predetermined order. In one case the intelligent display driver controller selects which one of a plurality of control sets to extract within the data sequence and disregards the others. Alternatively a user may request a specific control set, selectable via software, or a user may make a general request in which case all the control sets are sent to the intelligent display driver controller and the intelligent display driver controller selects which set is to be stored and which are to be disregarded. In either case the intelligent display driver controller a predetermined number of bytes of a control set are to be extracted. A third protocol has a signature and preamble precede a control set or a series of control sets. The preamble contains information regarding size, starting or ending point, or address information for the control set or sequence of control sets, to receive and store a control set in the proper locations within the intelligent display driver controller.

As the transmission of the desired control set is received and stored, the intelligent display driver controller appropriately transforms the pixel data and adjusts its control over the row and column driver circuits and the image quality is adjusted appropriately.

DETAILED DESCRIPTION OF THE PREFERRED EMBODIMENT

Figure 1:
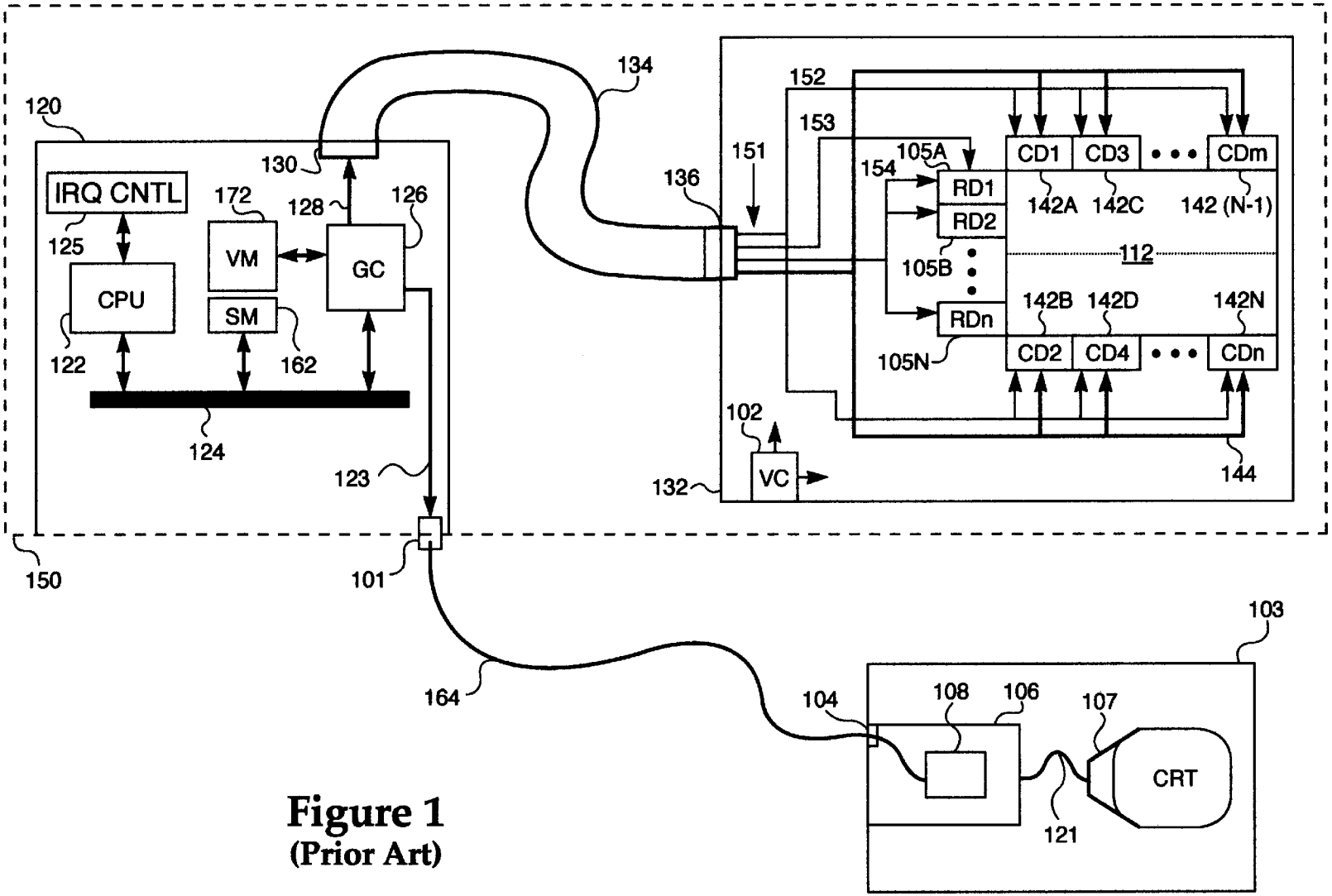
Figure 1 (Prior Art)
FIG. 1 is a block diagram of a conventional display system according to the prior art.
Figure 2:
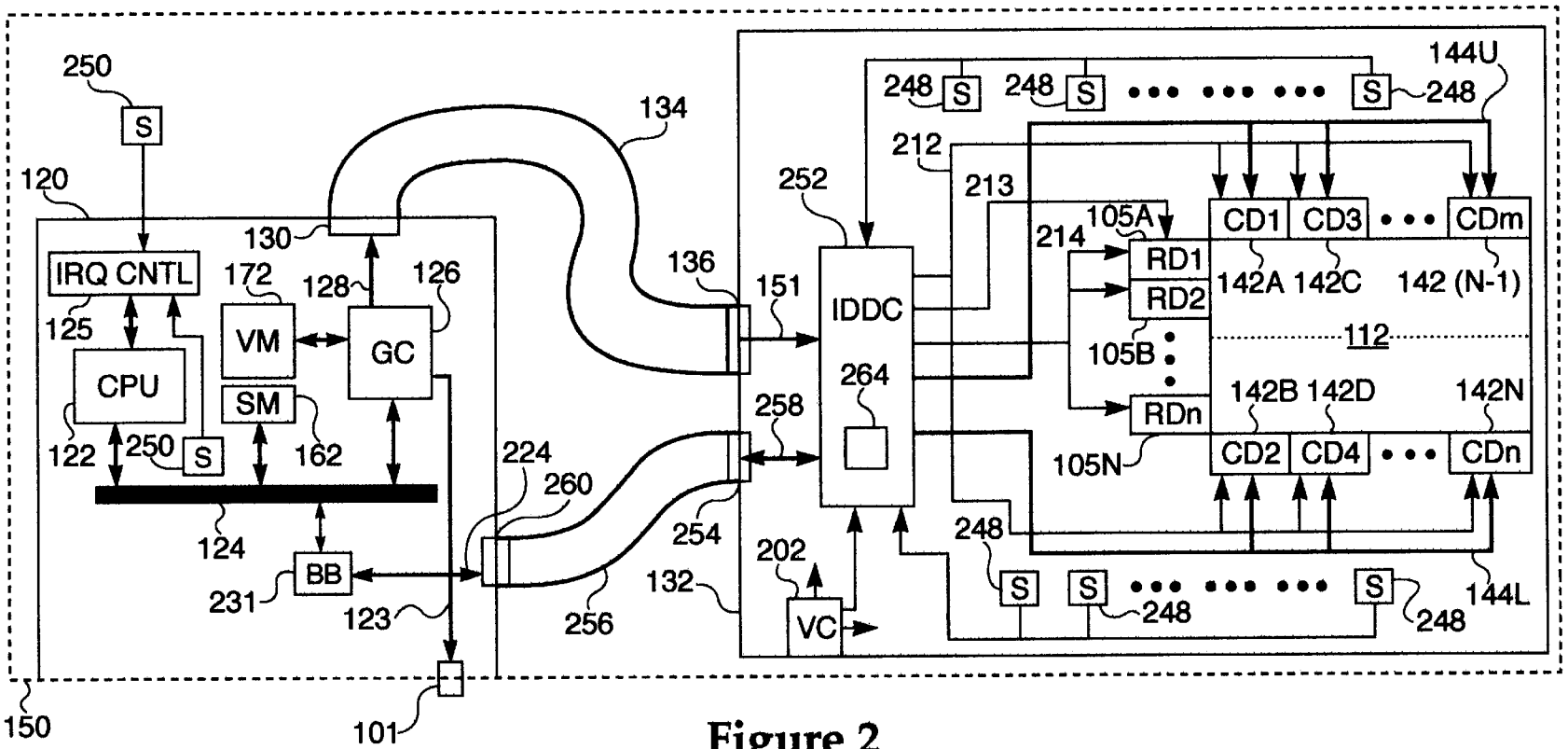
FIG. 2 is a block diagram of a first alternate embodiment of the present invention.

FIG. 2 shows a block diagram of a first embodiment of the present invention. Where appropriate to aid in understanding the various embodiments of the invention, those elements that are common to one or more of the various figures will be labeled with the same reference numerals. The system of the first embodiment includes a motherboard 120 having a CPU 122 coupled to an address/data bus 124 which is also coupled to a graphics controller 126. The graphics controller 126 is coupled to a display bus 128, to a first cable connector 130, a cable 134, a second cable connector 136 and to an intelligent display driver controller (IDDC) 252 via a first display bus 251. The IDDC 252 controls a plurality of column driver circuits 142X and row driver circuits 105X in a known manner.

Figure 4A:
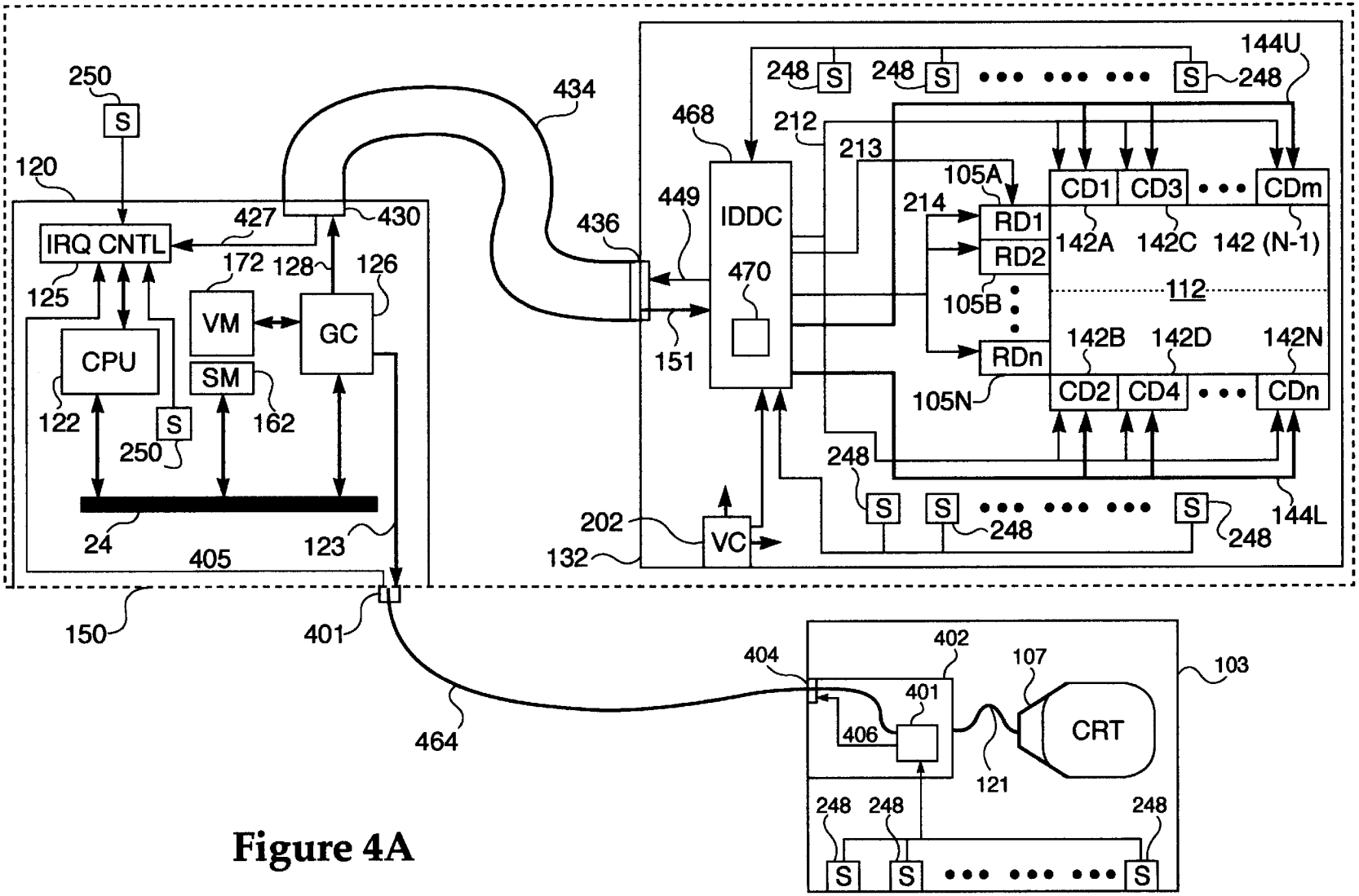
FIGS. 4A and 4B are block diagrams of the preferred embodiments of the present invention.

One or more transducers and/or sensors 248 may be within the panel display 132 or within the CRT display 103 (FIG. 4A). The transducers/sensors 248 within the panel display may be coupled to the IDDC 252. The transducers and/or sensors 248 will be collectively referred to as Sensors 248 throughout the remainder of this document. Other transducers and/or sensors 250 on the motherboard 120 or within the computer or multimedia system 150 may be directly coupled to the CPU 122 via the interrupt controller 125. These transducers and/or sensors 250 will be collectively referred to as Sensors 250 throughout the remainder of this document. Other integrated transducers/sensors may be within various components on the motherboard 120, within computer or multimedia system 150, or within the panel display 132 or the CRT display 103. An exemplary integrated transducer/sensor within a component of the system is the panel voltage converter 202 which may indicate a change in operating conditions. The Sensors 248 and 250, or integrated transducers/sensors measure or sense one or more parameters that can effect the image quality of the display such as temperature, voltage linearity or intrinsic characteristics of the display screen. An indicia that is representative of the value of the measured or sensed parameter is provided to the IDDC 252 by the Sensors 248 or integrated transducers/sensors such as within panel voltage converter 202. A control set storage 264 is included within the IDDC 252 for storing a control set. A control set is necessary information for transforming pixel data appropriately and providing appropriate control and data to the row 105X and column driver circuits 142X. Details of how the IDDC interfaces to the row and column drivers is provided in U.S. patent application Ser. No. 08/138,366 entitled "Signal Driver Circuit For Liquid Crystal Displays" filed by Callahan et al. on Oct. 18, 1993 which is incorporated herein by reference.

The IDDC 252 may be coupled to the CPU 122 via a secondary communication path including a second display bus 258, a third connector 254, a second cable 256, a fourth connector 260, a bus 224, a bus buffer 231, the address/data bus 124 and the CPU 122. The second cable 256 is coupled between the third connector 254 and the fourth connector 260. The fourth connector is coupled to the bus buffer 231 by the bus 224. The address/data bus 124 is coupled between the bus buffer 231 and the CPU 122. In the alternative, the cable 134 can be expanded to include all of the extra control signal lines that would otherwise be included in the cable 256. In the case when the cable 134 is expanded, the secondary communication to the CPU 122 may be accomplished through a modified graphics controller, over the extra control signal lines within the expanded cable, instead of using an extra cable such as cable 256. However, it is preferable that no modifications are made to the graphics controller, in which case the extra signal lines within the expanded cable may simply be routed to a buffer, such as bus buffer 231.

In the event that the indicia provided by the Sensors 248 or integrated sensor/transducers to the IDDC 252 change by more than a predetermined value, the IDDC 252 transmits a request to the CPU 122 via the secondary path. The CPU 122 can be configured by appropriate software programming to calculate a new control set for the IDDC 252. In the alternative, a plurality of new control sets can be stored in a system memory 162. In such a case the CPU 122 interrogates system memory 162 and selects the appropriate new control set. Once the new control set is determined, either by calculation or selection, the new control set is communicated to the IDDC 252 via the secondary path and stored into the control set storage 264. The IDDC 252 drives pixel data onto 144U and 144L. Other timing control for the row 105X and column drivers 142X are provide by lines such as 212, 213, and 214. By so updating the control set storage 264, the image quality can be manipulated appropriately through means such as the pixel data sent onto the lines 144U and 144L or by modifications in the timing control lines 212, 213, and 214.

A primary disadvantage of using this first embodiment is that the interface architecture between the motherboard 120 and the display system 132 is not standard because of the secondary path for communication. In one case an extra cable 256 and buffer 231 is required. In another case, the graphics controller 126 may be modified in order to support the extra command signal lines and a much larger nonstandard cable having extra signal lines is required as well. Thus, this first embodiment would require many changes from the standard system hardware in order to properly support sending a control set to a display. Persons having ordinary skill in the art recognize that computer equipment and work-stations manufacturers require interchangeable components. Failure of this first embodiment to provide such interchangeability will cause such a system to have a limited proprietary market.

Figure 3:
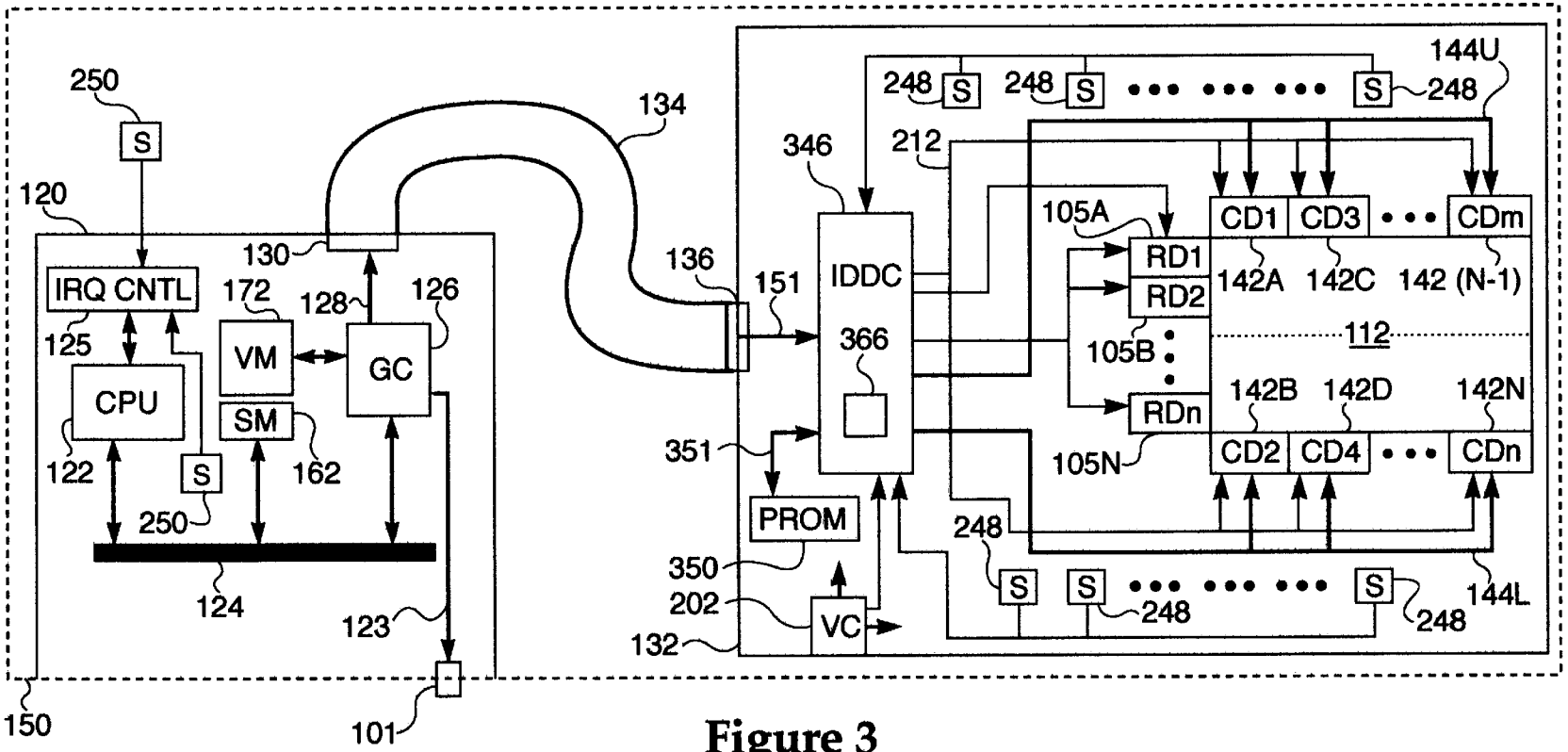
FIG. 3 is a block diagram of a second alternate embodiment of the present invention.

FIG. 3 shows a block diagram of a second embodiment of the present invention. The system of the second embodiment includes a motherboard 120 having a CPU 122 coupled to an address/data bus 124 which is also coupled to a graphics controller 126. The graphics controller 126 is coupled to a display bus 128, a first cable connector 130, a cable 134, a second cable connector 136 and to an intelligent display driver controller (IDDC) 346 via a first display bus 151. The IDDC 346 controls a plurality of row 105X driver circuits and a plurality of column driver circuits 142X in a known manner, such as described above. One or more transducers and/or sensors 248 and integrated transducers sensors, such as within the panel voltage converter 202, are coupled to the intelligent driver controller 346. The Sensors 248 or integrated transducers/sensors measure or sense one or more parameters that can effect the image quality of the display such as temperature, voltage linearity or intrinsic characteristics of the display screen. An indicia that is representative of the value of the measured or sensed parameter is provided to the IDDC 346 by the Sensors 248 or panel supply voltage 202.

A PROM 350 is coupled to IDDC 346. The PROM 350 contains a plurality of control sets. Each control set provides the IDDC 346 with information sufficient to control the display drivers 142X and 105X depending upon the indicia provided to the IDDC 346 by the Sensors 248 or the panel voltage converter 202. In order to store the various control sets required, PROM 350 needs to be quite large. A small PROM (not shown) or memory space within PROM 350 can be utilized to store the initialization data for the IDDC 346.

Assuming operation under steady state measured or sensed parameter(s), the IDDC 346 accesses a predetermined address space within the PROM 350 for retrieving data necessary to control the display image quality at a particular level. The starting address for the address space within the PROM 350 can be held in a register of the IDDC 346. An address counter can be incremented from the register value as each new value is read to update the control set. Once the maximum count is reached, the counter is reset with the register value.

As the measured or sensed parameter(s) changes, the indicia provided to the IDDC 346 changes. Upon reaching a predetermined change in the indicia, a new starting address is computed within the IDDC 346 and a new address space within the PROM 350 is selected. The IDDC 346 increments through the new PROM address space to read the new control set into the control set storage 366 via the PROM address/data bus 351. In one case the new control set can be loaded immediately even though control set changes slightly modify the data displayed on the screen. Alternatively the new control set can be loaded during the non-display period (retrace) to effect the change in the next frame. Other wise the new control set could be loaded over a few frames in which case the display may have different levels of shading corrected and uncorrected for the changed environmental conditions.

Several basic alternatives to this technology will be apparent after reading this disclosure. For example, a person of ordinary skill in the art will recognize that the IDDC 346 can simply point to an appropriate address space within the PROM 350 and the pixel data can further select an address in order to read out proper display data from the PROM 350. Changing the control set simply requires changing the address space pointed to by the IDDC 346.

The memory holding the display sets must be programmable to accommodate the various display types that shall have different control set values. Thus, a disadvantage of this second embodiment is that programmable memories such as PROM, EPROM, and EEPROM semiconductor processing are more expensive than conventional MOS or CMOS technologies. Integrating the PROM 350 and the IDDC 346 onto the same integrated circuit is also more costly to manufacture than conventional MOS or CMOS technologies. Accordingly, additional board space will be required to accommodate the external PROM 350. However, as a distinct advantage over the first embodiment, is that a conventional graphics controller 126 can be used along with conventional connectors 130 and 136 and the cable 134. Thus, a manufacturer or user of a motherboard or computer system can simply replace an existing display unit 132 with one having the improvements of the second embodiment of the present invention. No alterations or modifications to the hardware of the computer system will be required. Indeed, utilization of the second embodiment is completely transparent to any standard computer system to which such a display system is coupled.

PREFERRED EMBODIMENT

Figure 4B:
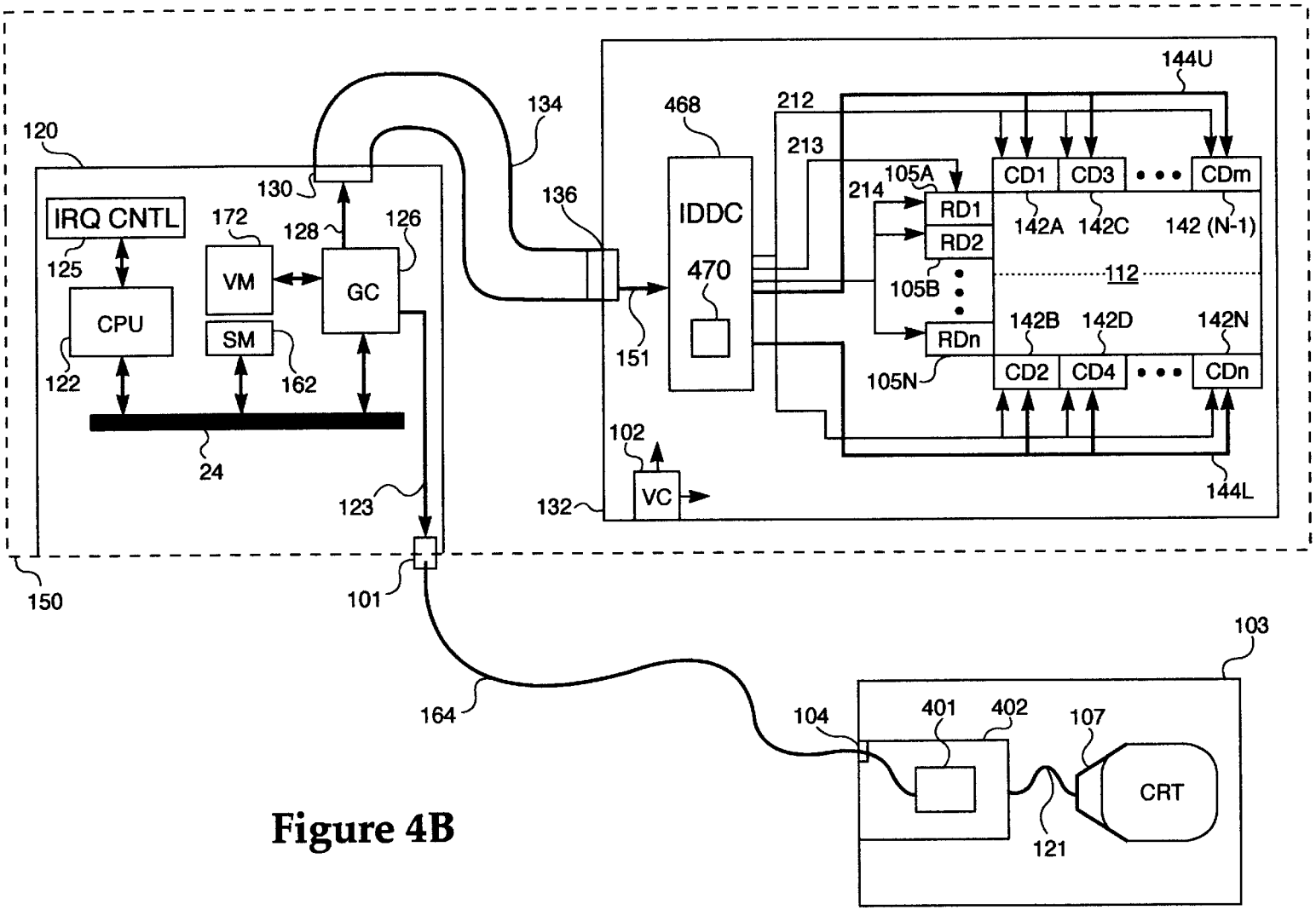
Figure 8A:
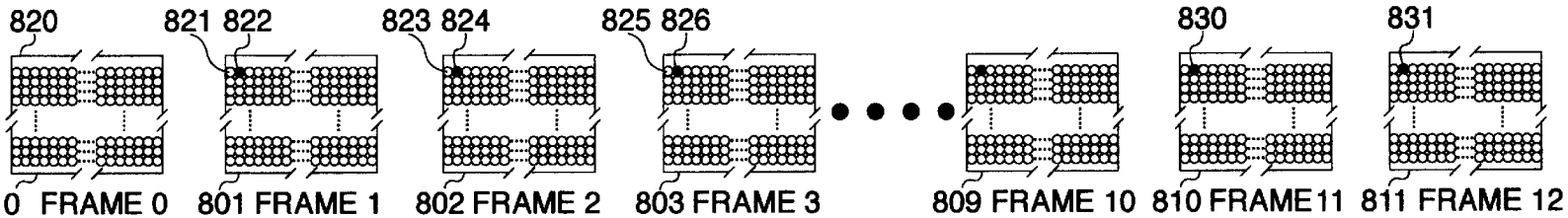
FIGS. 8A, 8B, and 8C illustrate a series of frame images showing various methods of substituting pixel positions by a signature word and control set number and, the replication of the previous pixel to minimize image degradation.
Figure 8B:
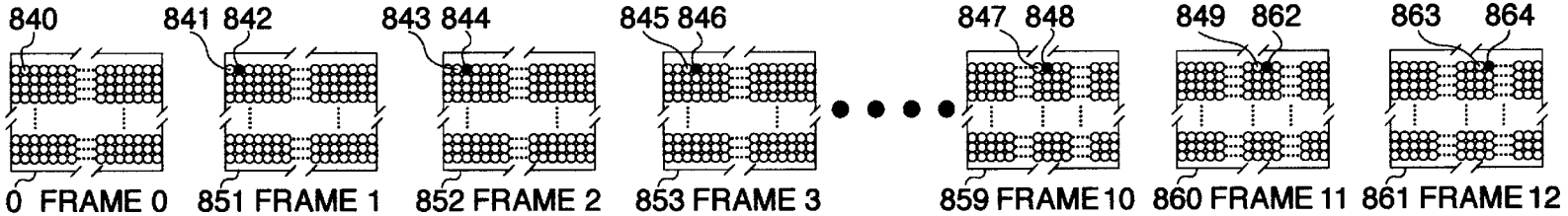
Figure 8C:
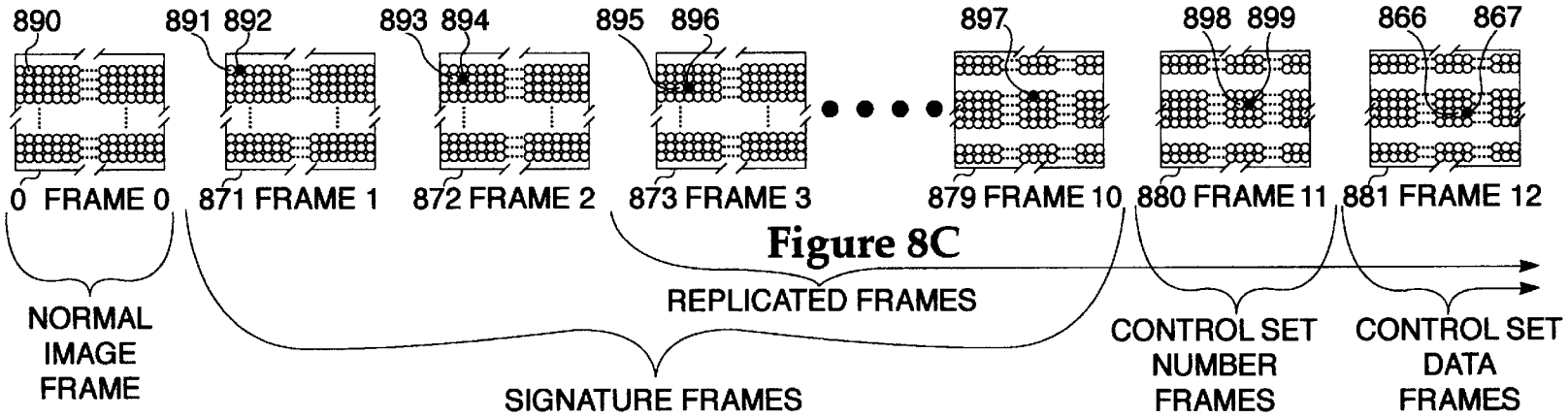
Figures 9A, 9B, 9C:
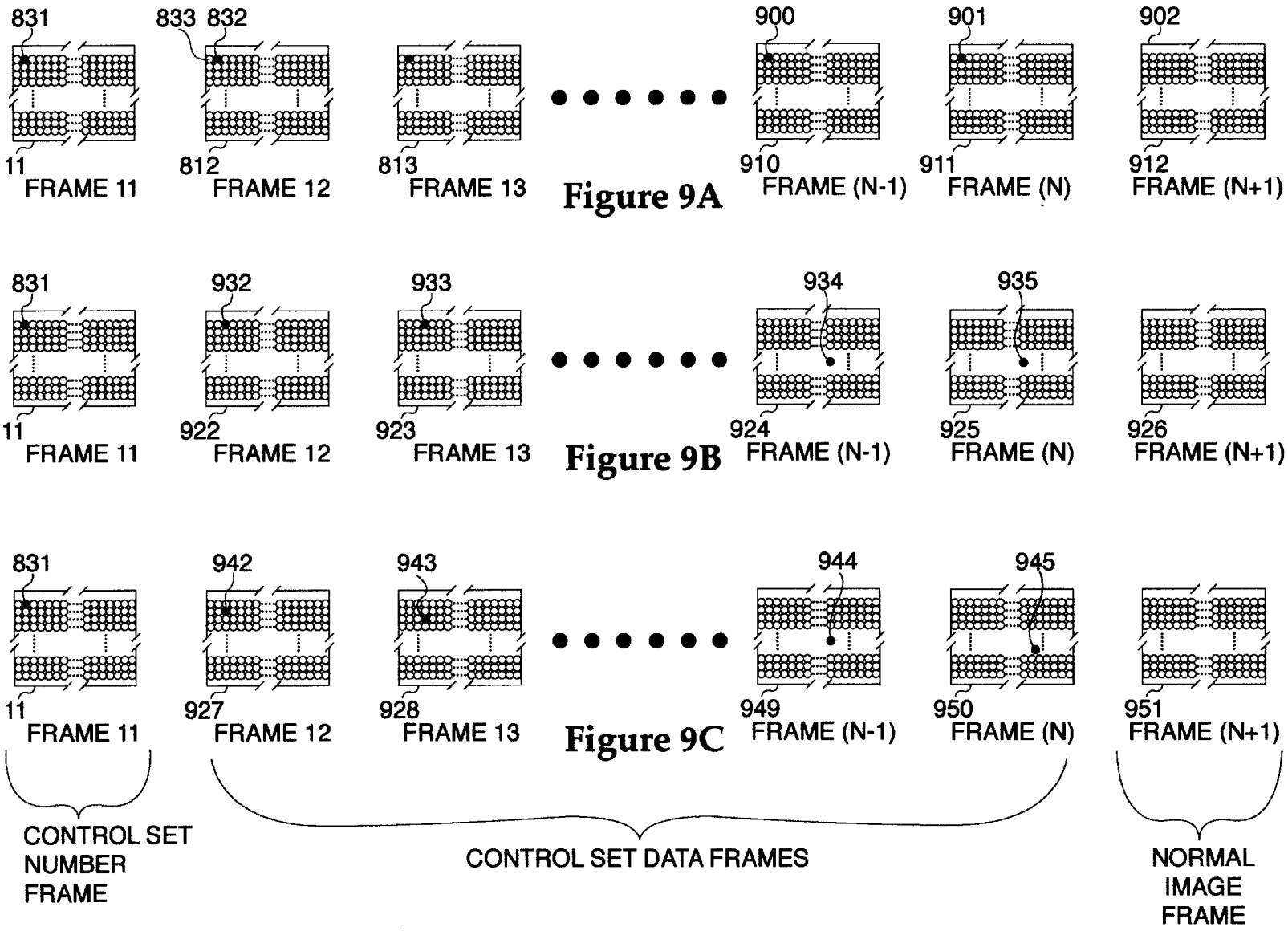
FIGS. 9A, 9B, and 9C illustrate a series of frame images showing the first method of signature word replication in FIG. 8A and various methods of substituting control set words for pixels and replicating the previous pixel in order to minimize image degradation.

FIGS. 4A and 4B show block diagrams of a third and preferred embodiment according to the present invention. The IDDC 468 detects a signature over a series of frames as illustrated by FIG. 8A–8C. The IDDC then detects a control set number within the first frame of the control set and then decides whether to capture one of a plurality of control sets. The control set is captured over a series of frames such as illustrated by FIGS. 9A–9C. The transmission of the signature and a control set from the CPU 122 is transparent to the graphics controller 126. Referring to FIG. 4A, the system of the third embodiment includes a motherboard 120 having a CPU 122 coupled to an address/data bus 124 which is also coupled to a graphics controller 126. In FIG. 4A the graphics controller 126 is coupled to a display bus 128, a first cable connector 430, a cable 434, a second cable connector 436 and an intelligent display driver controller (IDDC) 468 via a first display bus 151. In this case, the cable 434 has been modified from the standard cable 134 to include a single interrupt signal line 449 from the panel display 132. An interrupt is generated by the IDDC 468 in response to changes in the Sensors 248 or integrated transducer/sensors and driven onto the interrupt signal line 449. The interrupt signal line 449 is coupled to the connector 436, the cable 434, a connector 430, an interrupt bus 427. The interrupt bus 427 is coupled to interrupt controller 125.

In addition to the Sensors 248, Sensors 250 and integrated transducers/sensors generating interrupts to the CPU via the IDDC 468, software may be used to generate interrupt signals to the CPU to update a control set. Alternatively, software alone may be used to initiate an update in the control set by interrupting the CPU. In this case, where software alone is used, the Sensors 248, the Sensors 250, the modified cable 434 and associated modified connectors are not necessary as illustrated by FIG. 4B. It is preferable that a combination of software and hardware Sensors 248, Sensors 250, or integrated transducers/sensors are used to initiate the interrupts. In any case the IDDC 468 controls a plurality of driver circuits 142X and 105X over driver data bus 144 (144U and 144L) in a known manner such as described in the Callahan et al reference cited above. Also in any case the IDDC 468 can accept a signature, control set number, and a control set according to the preferred embodiment, across the standard pixel data lines, from either the standard cable 134 or the nearly standard cable 434.

In FIG. 4A, one or more transducers and/or sensors 248 and the integrated transducers/sensors such as within the panel voltage converter 202 are coupled to the IDDC 468. The Sensors 248 and the integrated transducers/sensors such as within panel voltage converter 202 measure or sense one or more parameters that can effect the image quality of the display such as temperature, voltage linearity or intrinsic characteristics of the display screen. An indicia that is representative of the value of the measured or sensed parameter is provided to the IDDC 468 by the Sensors 248.

A control set storage 470 is preferably formed integrally to IDDC 468. The control set storage 470 may be a random access memory (RAM), random access memory look-up-table (RAMLUT), register set or some other storage means preferably integrated within the IDDC. The control set storage 470 contains a single control set which corresponds to the measured or sensed parameter value for the IDDC 468 to use in controlling the driver circuits 142X and 105X to maintain the image quality at a particular level. Upon start-up or reset, the control set storage 470 will be loaded with a predetermined initial set of information. Assuming operation under a steady state of measured or sensed parameter(s), the IDDC 468 will process image data received from the graphics controller 126 in the usual manner. As the measured or sensed parameter(s) changes, the indicia provided to the IDDC 468 also changes. Upon reaching a predetermined level of change in the indicia, the IDDC 468 provides an interrupt signal to the CPU over the cable 434 via the interrupt signal line 449. The interrupt signal is sent to the interrupt control logic 125 via the interrupt bus 427. In the case when the user requests a control set change, the software application provides a user selection such that an interrupt is sent to the CPU via software to update the control set within the IDDC 468.

The CPU 122 is configured to recognize the display system 132 as one of the many sources of interrupt signals. Upon receiving an interrupt signal from the display system 132, the CPU determines the source of the interrupt. After the CPU determines that the display system has requested service, it interrogates the system memory 162 to retrieve a plurality of control sets. The CPU 122 then transmits all of the control sets to the display system 132 in a predetermined order. Based upon the new value of the indicia, the IDDC 468 selects an appropriate one of the control sets transmitted from the motherboard and stores it into control set storage 470.

In the case of a software update request, the user may request an update to a predetermined control set in which case the CPU 122 need only transfer the selected control set. If a general update is requested by the user the CPU 122 can send all control sets to the IDDC 468 such that it may select the appropriate control set to store within the control set storage 470 based upon the indicia received from the Sensors 248 or integrated transducers/sensors if any are attached.

Figure 10A:
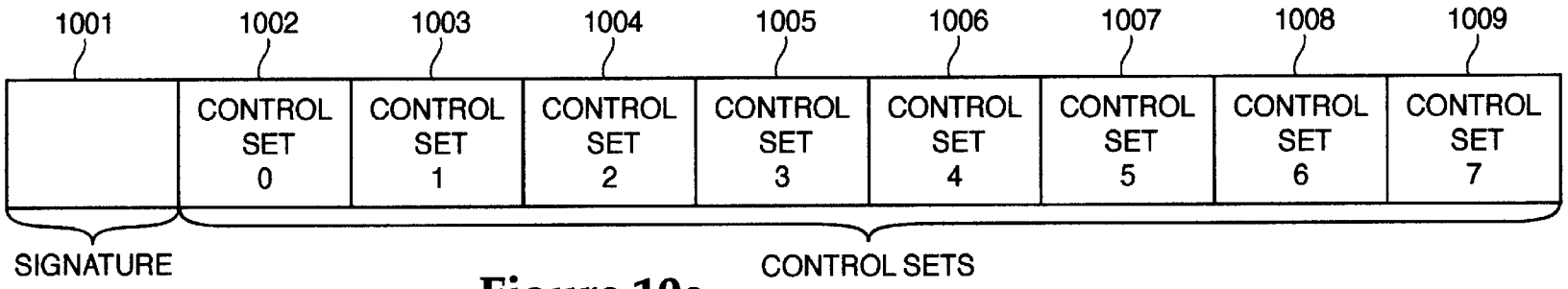
FIGS. 10A, 10B, and 10C illustrate the preferred and alternate protocols for transmitting control sets to the display system within the stream of pixel data.

The IDDC 468 may select the appropriate control set in a variety of methods using various protocols. In one case the length of each control set is predetermined and known by the IDDC. The order in which the control sets are sent to the IDDC by the CPU is also predetermined and known by the IDDC. From the indicia it receives from sensors or software, the IDDC knows which control set it desires to read and thus merely waits for the appropriate point to start capturing the desired control set within the series of control sets that are sent one after another by the CPU. FIG. 10A illustrates the protocol of how the signature, control set number, and control sets would be transferred. The signature 1001 would be first transmitted and then the control sets 1002–1009 would be transmitted.

Figure 10B:
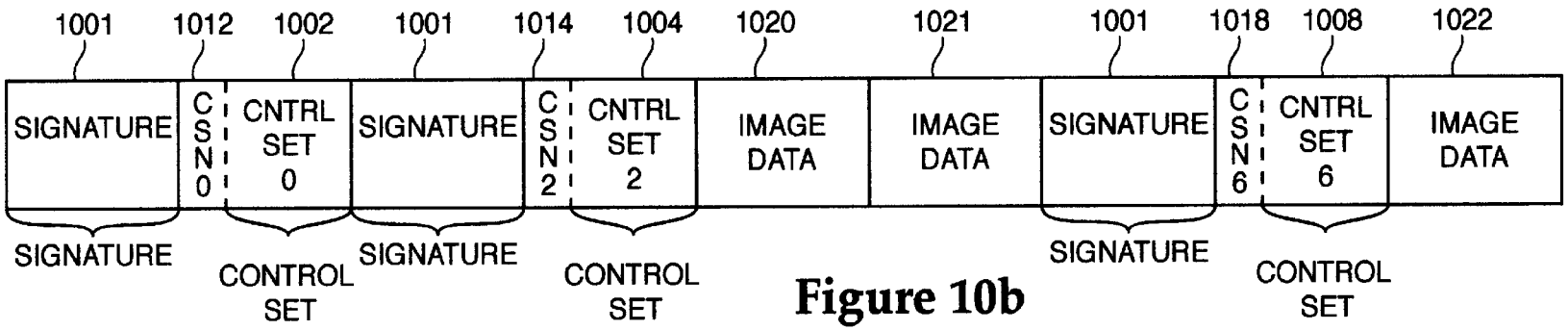

FIG. 10B illustrates the preferred embodiment for the transmission protocol. A signature 1001 made up of a sequence of signature words is first transmitted before each control set is transmitted. After each signature a control set number (CSN) and a matching control set are transmitted. A control set number CSN precedes the control set and indicates which one of the plurality of control sets follows. The control set number may be the first control set word of each control set or it may be the first byte of the first control set word of each control set. Preferably the control set number is independent from the control set in that it is transmitted in the frame previous to the start of control set as illustrated by FIG. 10B. In any case the control set number represents a default value, a forced value, or a desired value. For example, consider the control set number having a range of values from 0–7. A control set number of 0, a default value, may represent the CPU transmitting the initial start up control set and that the IDDC by default should accept it. A control set number of 1, a forced value, may represent the CPU forcing the IDDC to accept the corresponding control set as the update to registers within the control set storage. A control set number of 2 could represent the CPU forcing the IDDC to accept this control set as the update to the RAMLUT. A control set number of 3 may represent the CPU forcing the IDDC to accept the according control set as the update to both the registers and the RAMLUT within the control set storage. Control set numbers from 4–7, representing a range of desired values, may represent the selectable or environmentally corresponding control sets. It is envisioned that the forced control sets may be selected by the user according to their perception of the image, overriding the selection by the Sensors or Transducers. However, the CPU for various reasons may provide a forced control set overriding the selection by one or more of the Sensors or Transducers as well. In any case the IDDC will look at the control set numbers, automatically accept a control set having a default or forced value as the control set number, and selectively pick only the control set having a desired value for the control set number.

Control sets may be transmitted one after another or image data be transmitted between control sets. In either case, a signature 1001 precedes each group of control sets. An example of how image data is interspersed between control sets is illustrated in FIG. 10B. The control sets 0 and 2 are sent after the signature 1001, followed by two frames of image data 1020 and 1021. The control set 6 is then preceded by a signature 1001 and then sent, followed by a frame of image data 1022.

Figure 10C:
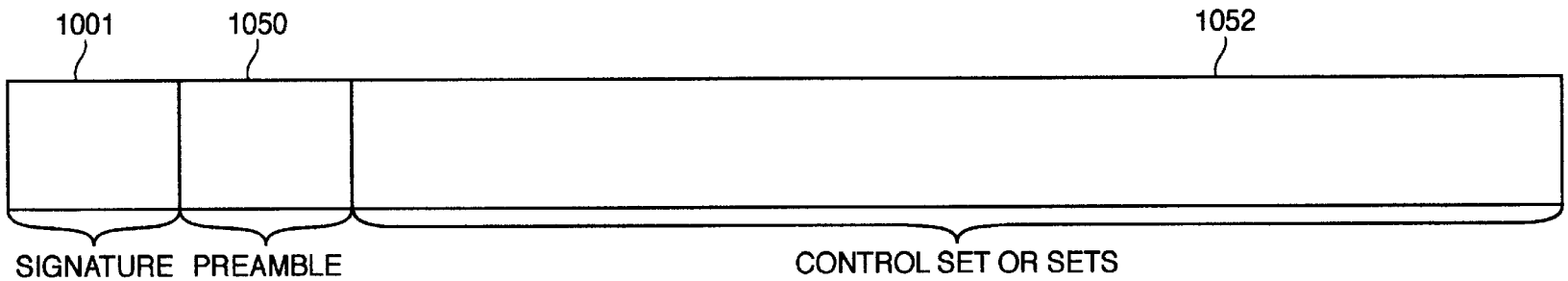

Referring to FIG. 10C an alternate protocol is shown which transmits a preamble 1050 after the signature 1001 is sent. The preamble 1050 includes information for the IDDC regarding the following control set or sets 1052. It is envisioned that the preamble may contain information about the length of the control sets as well as a starting or ending address pointing to the appropriate control set storage within the IDDC such as registers or RAMLUT. This would allow the transmission length of a control set or a series of control sets to be variable. It is possible that other protocols used in serial transmission schemes for encapsulating data could be used.

Control Set Transfer

It is important that any modifications to the operation of the circuit of the present invention are effectively transparent to any user of the digital system. It is also important that any modifications to existing hardware are kept to a minimum. It is desirable to use either a standard cable such as cable 134 shown in FIG. 4B or a nearly standard cable such as cable 434 shown in FIG. 4A. The cable 434 includes only one additional signal line, an interrupt request line for carrying an interrupt request signal. Thus, the existing pixel data lines are used to transfer the signature word, control set number, and control set words from the motherboard 120 to the display system 132. A conflict arises because it is desirable to transmit all of the control sets, having a length of approximately 8 Kbytes, to the display system 132, while at the same time transmitting image data. If the system stops transmitting image data to transmit the control sets, the display will become distorted until image data can again be transmitted. This of course is unacceptable because it will be perceptible to a user.

To resolve this problem the control set is sent sequentially over a number of frames to the display system 132, across the pixel data lines, in a manner imperceptible to the human eye. The CPU 122 substitutes the appropriate pixel data, with the data in the new control set, in an operation transparent to the graphics controller 126, in order to sequentially send the control sets over the standard cable. The control set is transmitted in place of image data for one or more pixels in the corresponding one or more locations in the video memory 172, for a given frame. The IDDC 468 is preconditioned to anticipate which pixel locations, e.g., which 24 bits of pixel data (pixel word) in the sequential stream of data forming a frame, have been replaced by a substituted control set word.

It is almost a certainty that a control set word will not match the image data or pixel word. Rather than display the control set word in the image, which will undoubtedly result in a garbage pixel in the displayed image, the IDDC 468 duplicates the data representing a pixel prior to the pixel location where a control set word is expected. This duplicated data substitutes for displaying the control set word on the screen. In the preferred embodiment the pixel word used to provide the duplicated data is the pixel immediately proceeding the pixel location containing the control set word. This process of duplication of the previous pixel and substitution into the pixel location of the control set word is referred to as replication. For a vast majority of images, this replication will result in an image that will appear identical to the true image had the control set word not been substituted for the pixel. In the preferred embodiment, the substituted pixel is the second pixel within the first row that is located in the upper left hand corner of the display. The first pixel is not used because the IDDC 468 has not yet received a previous true display pixel that may be duplicated. FIG. 9A illustrates this replication process where the pixel 833 is replicated into the pixel 832 at frame 12 (812). The control set is transmitted from frame 11 (811) through frame N (911). The replication process is repeated across these frames until the complete control set has been transmitted and received by the IDDC 468.

Figure 5B:
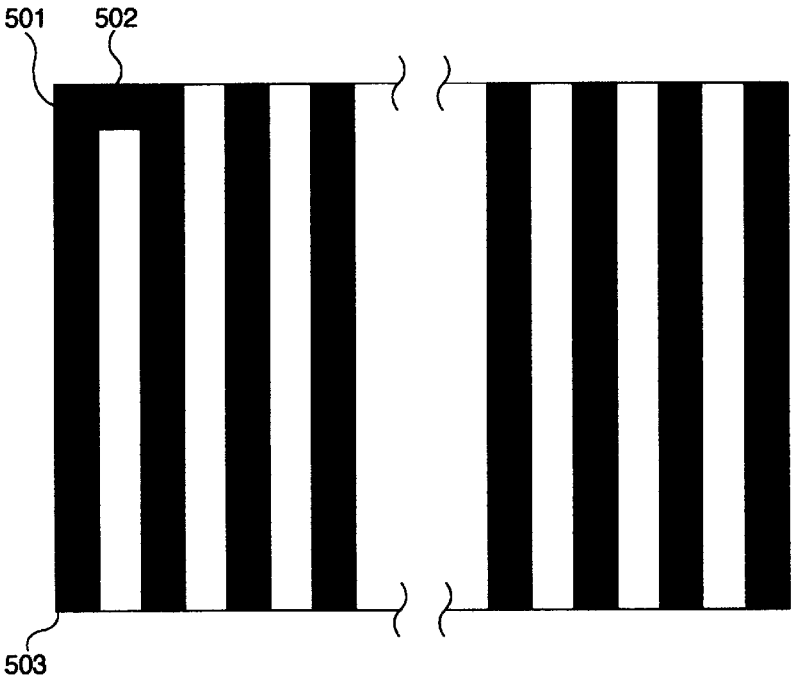
FIGS. 5A and 5B illustrate how an image may be effected by the replication of the previous pixel by one method of the present invention.
Figure 5A:
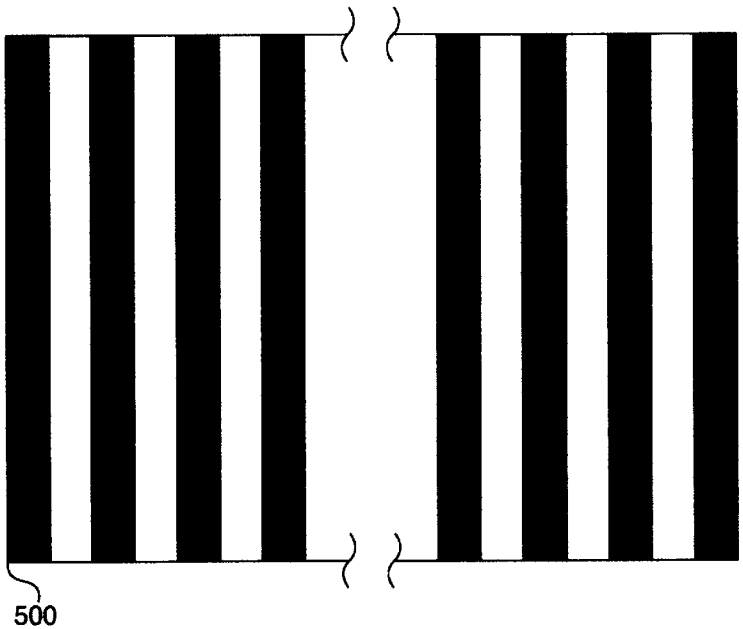

For certain types of images, such as an image containing alternating columns of black and white, selecting one or more predetermined locations for interposing the control set word will not be transparent to a user. FIG. 5A shows a display with a frame 500 having alternate columns of black and white pixels. By duplicating the image data from the previous pixel 501 into the substituted pixel position 502 (i.e. replicating pixel 501 into pixel 502) the image will appear defective as illustrated by frame 503 in FIG. 5B.

To alleviate this problem the replicated pixel location may be changed over each frame as illustrated by FIGS. 9B and 9C. FIG. 9B illustrates the replicated pixel location moving sequentially pixel by pixel along the row, through the frames, similar to how pixels are scanned across a panel. FIG. 9C illustrates the replicated pixel location moving diagonally across the screen. Alternatively any predetermined pixel pattern could be selected such that the IDDC 468 would know where the CPU had placed the control set word. Because a frame only remains on the display for approximately 16 milliseconds, such a scheme will effectively obscure the defective data from typical users. It is only necessary that the IDDC 468 and the CPU 122 each recognize which pixels will contain substituted pixel data. In the preferred embodiment, the substituted pixel will move M pixels at a time. For example, if M=1, in the first frame, the substituted data will appear in the second pixel; in the second frame, the substituted data will appear in the third pixel, in the third frame, the fourth pixel is changed and so on as illustrated by FIG. 9B. Though possible to move to random or pseudo-random locations from one frame to the next, it will of course be necessary for the CPU 122 and the IDDC 468 to remain synchronized.

Signature Detection and Replication

Because the control set information replaces pixel information sent over a standard cable 134 or nearly standard cable 434, the IDDC 468 must determine when to properly start capturing control set words within the stream of pixel information. To indicate the start of a transmission of a stream of control set words, the CPU 122 will send a signature to the IDDC 468. FIGS. 8A–8C illustrate a signature having an exemplary length of 10 pixels or 10 signature words transmitted over frames 1 through 10 (801–810). The IDDC 468 is configured to always look for the signature except when receiving a control set. The signature should be a data stream of more than one pixel to avoid the possibility that an image data is identical to the signature word. The longer the signature, the smaller the probability that image data will be mistaken for a signature word. In the preferred embodiment the signature is ten pixels or 10 signature words in length. Once two or three signature words have been detected the replication process as described above may begin.

Referring to the example of FIG. 8A, frames 0 (800) is displaying a normal image and the signature starts to be sent to the display by the graphics controller in frames 1 (801). In this example the signature has been completely sent to the display by the end of frames 10. In frames 11, after the sequence of signature words is completely sent, the transmission of the control set begins and the replication process continues. In frames 11 (811), pixel 831 has been replicated so that the control set word can be transmitted in its place. In frames 1 (801) and frames 2 (802) the signature word is actually displayed on the screen at pixel locations 822 and 824. For this example the replication process as described above does not start until frames 3 (803). Thus in frames 2 the second signature word 824 has been detected but pixel 823 has not been replicated into pixel 824. However in frames 3 (803), pixel 825 has been replicated into pixel 826 in order to mask the transmission of further signature words. If no further sequence of signature words within a signature are received by the IDDC 468 than the replication process is terminated and the signature detection system is reinitialized. If further signature words are received, the replication process continues through the complete signature as well as into the frames where the control set is received as described above. It should be obvious to one of ordinary skill in the art that the signature sequence length (number of signature words within a sequence) and control set length may be varied such that the number of frames over which the information is substituted for image data may vary.

In FIG. 8B, the signature is sent over the same number of frames as the signature of FIG. 8A, but the number of the pixel where the signature is being sent is changing with every frame. In the system illustrated in FIG. 8B, the pixel in which the signature data is being sent, is incremented with each respective frame. In the system illustrated in FIG. 8C, the pixel in which the signature data is being sent is increasing with each respective frame by a number of pixels N.

It is possible that the signature words can be stored in both the IDDC 468 and the system memory 162. Then when the CPU 122 prepares to transmit the control set information, it first retrieves and transmits the signature and then transmits the control sets. While a signature sequence may be, made of few signature words it is preferred that the signature sequence be longer such as 10 words (30 bytes of 8 bits) over 10 frames. A longer signature length has a lower probability of matching actual pixel words representing an image and falsely detecting a signature sequence. The internal space necessary to store a long signature within ROM, PROM or EPROM on the IDDC 468 integrated circuit may be excessive which is more costly. ROM, PROM or EPROM external to the IDDC 468 used to store a long signature is more costly as well because of the extra component count and size of the device. Alternatively random logic could be used to detect a signature that is sent to the intelligent display controller. However for larger signature sequence lengths random logic would consume excessive space on the IDDC 468 integrated circuit. Rather, the preferred embodiment utilizes a pseudo-random number generator manufactured in hardware on the IDDC 468 and performed in software on the motherboard under control of the CPU 122. The software pseudo-random number generator under CPU control and the hardware pseudo-random number generator within the IDDC are preconditioned to begin from the same starting number so that both will generate identical streams of numbers. A hardware pseudo-random number generator including a register or other means for storing a starting point, and a comparator can readily be designed using less transistors and space on the IDDC 468 integrated circuit than an equivalent nonvolatile memory or random logic detector for a given signature sequence length. Less circuit space may be further conserved by utilizing an eight bit pseudo-random number generator and/or an 8 bit comparator. Three bytes from an 8 bit pseudo-random number generator may be concatenated together to form a single comparable 24 bit number for a 24 bit comparator. Alternatively, the 24 bit of pixel data can be compared 8 bits at a time by an 8 bit comparator provided with an 8 bit pseudo-random number generator. It should be obvious to one of ordinary skill in the art how the above circuits can be altered for a different pixel data width such as 18 bits in order to use less circuit space.

Hardware Description

Figure 6A:
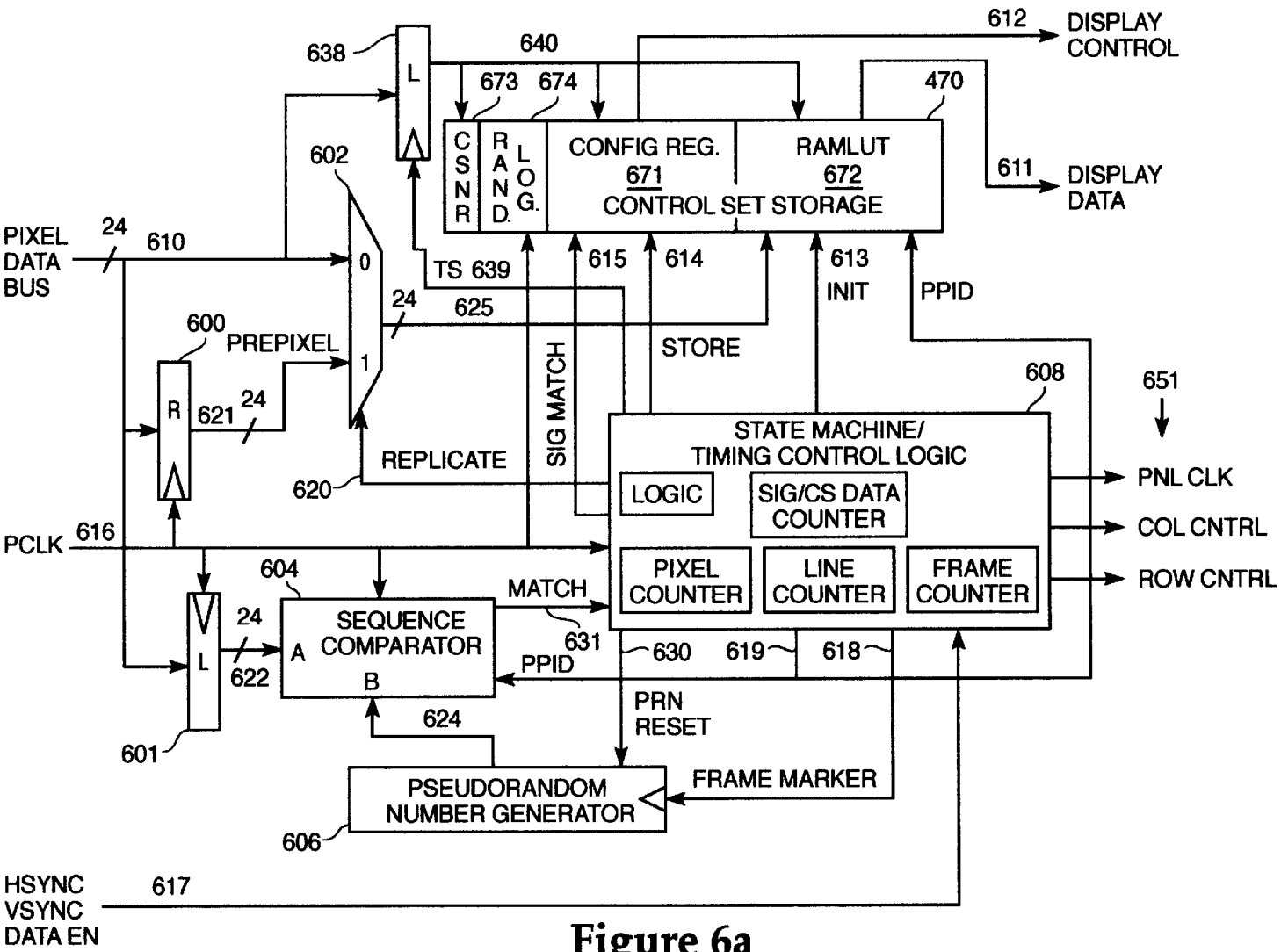
FIGS. 6A, 6B, and 6C show a more detailed block diagram of the intelligent display driver controller of the block diagram of FIGS. 4A and 4B.
Figure 6B:
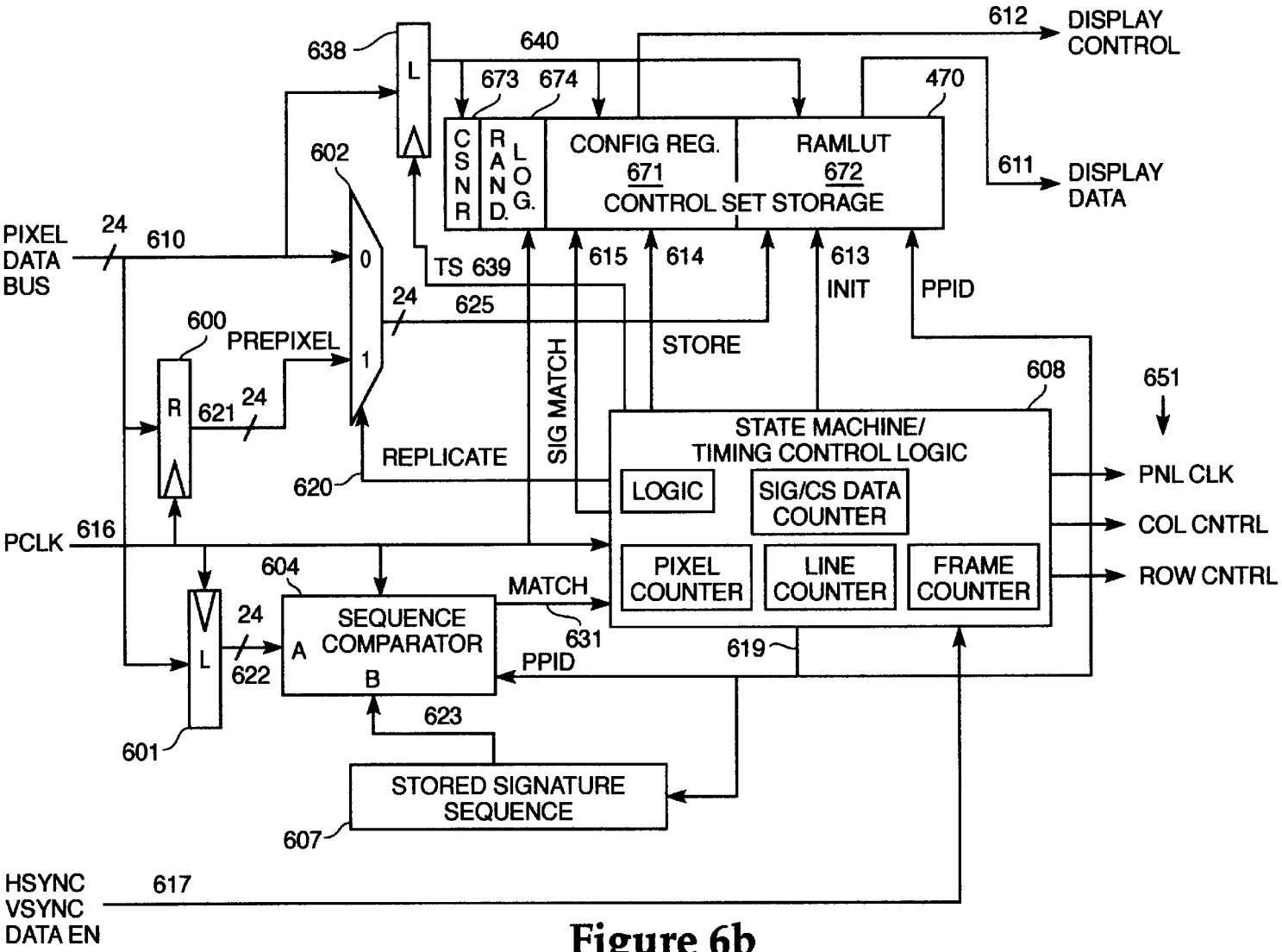

FIGS. 6A and 6B show a more detailed block diagram of the IDDC 468 of FIGS. 4A and 4B. In the preferred embodiment, the pixel data (24 bits), pixel clock signal (1 bit), horizontal/vertical synchronization and data enable (3 bits) are all received via the cable 434 in FIG. 4A or the cable 134 in FIG. 4B within the signal lines 151. In cable 434 an additional interrupt signal is present that is not within cable 134 that is carried on interrupt signal line 449. The pixel clock signal and the synchronization signals within signal lines 151 are received by the IDDC 468 and are used by the state machine/timing control logic 608 to appropriately control the row 105X and column drivers 142X in the conventional manner such as that described in the Callahan et al reference cited above and will not be discussed further here.

The pixel data signals on the pixel data bus are included within the signal lines 151 and are received by the IDDC 468. Each signal line within signal lines 151 is internally buffered (not shown) within the IDDC 468. The pixel data lines within the signal lines 151 are driven onto the pixel data bus 610. The pixel clock line within signal line 151 is driven onto the PCLK line 616. The horizontal line, the vertical sync line, and the data enable line within the signal lines 151 are driven onto the bus 617 labeled HSYNC, VSYNC, DATA EN. The pixel data bus is coupled to a latch 638, a multiplexor 602, a register 600, and to comparator 604, via the latch 601. Register 600 is clocked by PCLK line 616 to store the previous pixel data and drive the PREPIXEL lines 621 with the information stored therein. When image data is being transmitted, the PIXEL DATA BUS 610, which includes 8 bits each of red, green, and blue, is coupled to the multiplexor 602 such that pixel data are transmitted through the multiplexor 602 as PRE-DISPLAY DATA 625. When the pixel data representing a control set number is received it is temporarily stored within latch 638 and then stored in the control set number register (CSNR) 673. When control set information is to be received, the replication process occurs such that the previous pixel data stored in register 600 is transmitted through the multiplexor 602 to become predisplay data 625. The control set word on the pixel data bus 610 is temporarily stored into the latch 638 at the appropriate moment by the TS signal line 639. Control set word temporarily stored in the latch 638 is written into the configuration registers 671 or the random-access-memory look-up-table (RAMLUT) 672 during the blank or retrace period. The control set words stored within the configuration registers 671 of the control set storage 470 are then used to provide various controlled features of the panel display 132 via display control bus 612. Such controlled features include settings for the voltage converter 102 or 202, offset voltage settings for the DACs within the column drivers 142X, and other controls to compensate for intrinsic panel defects or problems. Control set words stored within the RAMLUT 672 of the control set storage 470 are used to slightly modify or transform the level of color that is selected by the predisplay data 625 to compensate for a degraded display quality. Preferably the RAMLUT 672 transforms the pixel data at the request of a user through software, or automatically via Sensors 248, 250, or integrated transducers/sensors, to correct for changed environmental conditions surrounding the panel display 132, inherent panel defects, or to satisfy a users perception.

Referring to FIG. 6A, a comparator 604 is used to detect a signature word by comparing pixel data stored within latch 601 with data from a pseudo-random number generator 606. The pseudo-random number generator 606 may generate one 24 bit number to match a 24 bit comparator or a sequence of three 8 bit bytes of random numbers to match an 8 bit comparator. The pseudo-random number generator in either case generates one 24 bit number or a series of three 8 bit pseudo-random numbers in response to a frame marker signal generated in the conventional manner within the state machine/timing control logic 608. State machine/timing control logic 608, under control of the PCLK signal 616, initiates a comparison of the data from the appropriate pixel location to the number generated by the pseudo-random number generator 606, by the pixel position identification signal (PPID) 619.

If no match is detected, the pseudo-random number generator 606 is reset via the PRN reset signal 630. If a match is detected, a signature counter in the state machine 608 is decremented from its value and the pseudo-random number generator 606 is conditioned to formulate the next three 8 bit numbers or a single 24 bit number upon detection of the next frame marker.

Upon sensing a predetermined number of matches (preferably 2 frame matches as in the above example and FIG. 8A) between the signature words received on the pixel data bus 610 over the cable 134 and the numbers generated by the pseudo-random number generator 606, the state machine/timing control logic 608 provides a replicate control signal 620 to multiplexor 602 to transmit the data from register 600 to the control set storage 470. In the preferred embodiment, the predetermined number of matches is two such as illustrated in FIGS. 8A–8C and the discussion above. The replicate control signal 620 is appropriately timed to correspond with the pixel location into which the CPU 122 is expected to place the next signature word. This effectively duplicates the image data from the previous pixel into the present pixel location to avoid displaying the signature word or control set word as described above. Because the probability is high that a complete signature will be received after several correct numbers are consecutively received it is desirable to start the replication process early within the signature word sequence. Once the predetermined number of matches are detected, the previous pixel data for the appropriate pixel is transmitted to the display because it is more likely that this data will match the true image than the signature word or control set word received from graphics controller 126. Recall that the graphics controller 126 does not sense that signature word or control set word has been substituted for pixel word. Only the CPU 122 and the IDDC 468 need know about the pixel substitution.

An indication that the entire signature has been detected is when the signature counter in state machine/timing control logic 608 has been decremented to zero from its initial predetermined maximum value. Once the entire signature has been detected, the state machine/timing control logic 608 then provides signature match 615, store 614, and PPID 619 control signals to the control set storage 470. In addition the TS signal 639 is provided to temporarily store the pixel data representing a control set number or the control set word into latch 638. These control signals are generated by a pixel counter, a line counter, a frame counter, and other logic within the state machine/timing control logic 608 which are responsive to the PCLK line 616; HSYNC, VSYNC, DATA EN bus 617; and match signal line 631. The TS signal 639 is a pulse which is appropriately timed to correspond with the pixel location into which the CPU 122 is expected to place the next element of the control set. The signature match signal 615 enables the control set storage 470 to begin storing or writing the control set number and control set words from latch 638 to the CSNR 673 or configuration registers 671 or RAMLUT 672.

The random logic 674 determines if the stored value within the CSNR 673 is a default value, forced value, or a desired value such that the following control set needs to be acted upon or not. The random logic 674 has information from the surrounding Sensors 248 (shown in FIG. 4) to determine the desired control set and compare that with the value stored in the CSNR 673. If the random logic 674 determines that the stored value within the CSNR 673 is a value such that the following control set or control sets need to be stored, the random logic 674 generates the appropriate addresses into the configuration register 671 or the RAMLUT 672 at the appropriate time. The present pixel identification (PPID) 619 in conjunction with the control set number provides a write address to the configuration registers 671 or RAMLUT 672 locations via the random logic 674. The store signal 614 provides the write strobe for the selected write address. The store signal 614 is a pulse which is provided during the blank or retrace periods to write data from the latch 638 into the control set storage 470. One of ordinary skill in the art will recognize that if a different protocols for transmission of control sets is used, such as that illustrated by FIG. 10A that does not require control set numbers, the CSNR 673 may not be required and the random logic 674 would operate in a different manner in response to signals from the state machine/timing control logic 608.

Figure 6C:
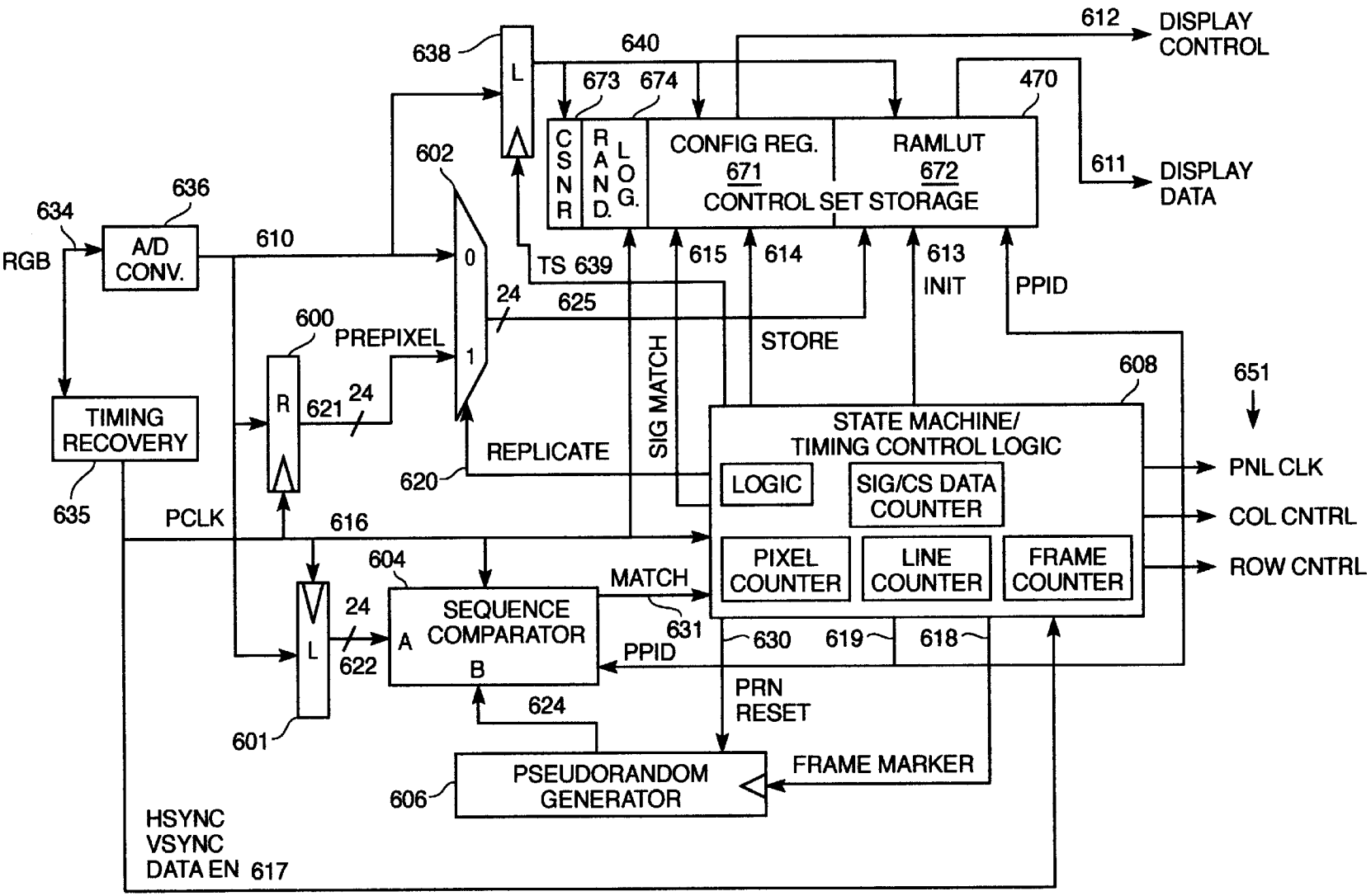

For each control set word that is stored into the control set storage 470, a control set word counter within the state machine/timing control logic 608 is incremented from its previous value. The control set word counter is initially set to zero. When the control set word counter reaches a predetermined maximum value, the end of the transmission of a control set from the graphics controller across the cable to the IDDC is indicated. In this case the replication process is stopped and the IDDC operates in a normal manner. The replicate signal is no longer pulsed during a frame time to read the previous pixel data from the register 600 until another signature word is detected. Pixel data on the pixel data bus is continuously transmitted through the multiplexor 602 onto the pre-display data bus 625. It should be obvious to one of ordinary skill in the art that the control set word counter can be the same counter as the signature counter described above when an up/down count capability is provided. It should also be obvious to one of ordinary skill in the art that any combination of incrementing or decrementing counters may be used if appropriate initialization values and terminal values are provided. A combined counter is illustrated in FIGS. 6A–6C by the block labeled SIG/CS DATA COUNTER within the state machine/timing control logic 608.

The pre-display data 625 provides a read address into the RAMLUT 672. The data read out from the RAMLUT 672 transforms the pre-display data 625 into the display data 611. The read and write operations into the RAMLUT 672 do not overlap. During the scan or display period, read operations are performed into the RAMLUT while during the blank or retrace period write operations are performed. Recall that the modifications to the control set storage occur over a number of frames. Thus, the RAMLUT will be slowly updated over a number of frames and the complete change to shades displayed on the screen will not be complete until some time has passed. This time may be varied by the length of the control set, the size of the RAMLUT, and the number of pixels simultaneously transmitted within a given cable. However because the modifications to the color shades are expected to be slight, the gradual change will be hardly noticeable by the typical user.

The state machine/timing control logic 608 also generates signals driven onto the panel clock, column control, and row control lines (PNL CLK, COL CNTRL, ROW CNTRL) 651. These lines are used to generate through buffers or other logic the timing control lines 212, 213, and 214 of FIG. 2–4.

FIG. 6B illustrates a modification to FIG. 6A in which a stored signature sequence 607 is used in place of a pseudo random number generator 606. The software pseudo-random number generator controlled by the CPU 122 and associated with FIGS. 6A and 6C is replaced with a stored signature sequence that is identical to the sequence stored within the stored signature sequence 607. In this case, a sequence of three 8 bit numbers or a single 24 bit number is provided to the comparator 604 in response to the PPID signal 619 by the stored signature sequence 607. If no match signal 631 is generated than the PPID signal is reset to read the first three 8 bit or single 24 bit sequence stored within the stored signature sequence 607. Recall in exemplary FIGS. 8A–8C, ten signature frames were used transmitting a sequence of ten 24 bit numbers. In this case, the stored signature sequence 607 would store ten 24 bit number sequences or thirty 8 bit number sequences to compare against the ten 24 bit numbers transmitted during the ten frame periods.

FIG. 6C illustrates a modification to FIG. 6A such that an intelligent CRT display driver controller (ICDDC) 401 may be incorporated into CRT display 103 on the intelligent CRT driver board 402 of FIGS. 4A and 4B. The hardware of FIG. 6C may be incorporated within the ICDDC 401. Referring to FIG. 6C for modifications from FIG. 6A, the RGB analog signals 634 are coupled to an analog-to-digital converter 636 generating digital pixel data bus signals 610. The timing signals pixel clock (PCLK) 616 and horizontal sync, vertical sync, and data enable (HSYNC, VSYNC, DATA EN) signals 617 are generated from the RGB analog signals 634 by the timing recovery block 635. FIG. 6C otherwise functions in a similar fashion to the hardware of FIG. 6A. The control set for the CRT display that is stored within the control set storage 470 may be different from the control set for the panel display. It is expected that a CRT control set may vary resolution, intensity, shades or other parameters associated with a CRT display. In this manner the conventional CRT displays as well as newer HDTV displays may have control set information transmitted from some digital system such as the computer or multimedia system 150 to further control the image that is to be displayed.

State Machine/Timing Control Logic Operation

Figure 7:
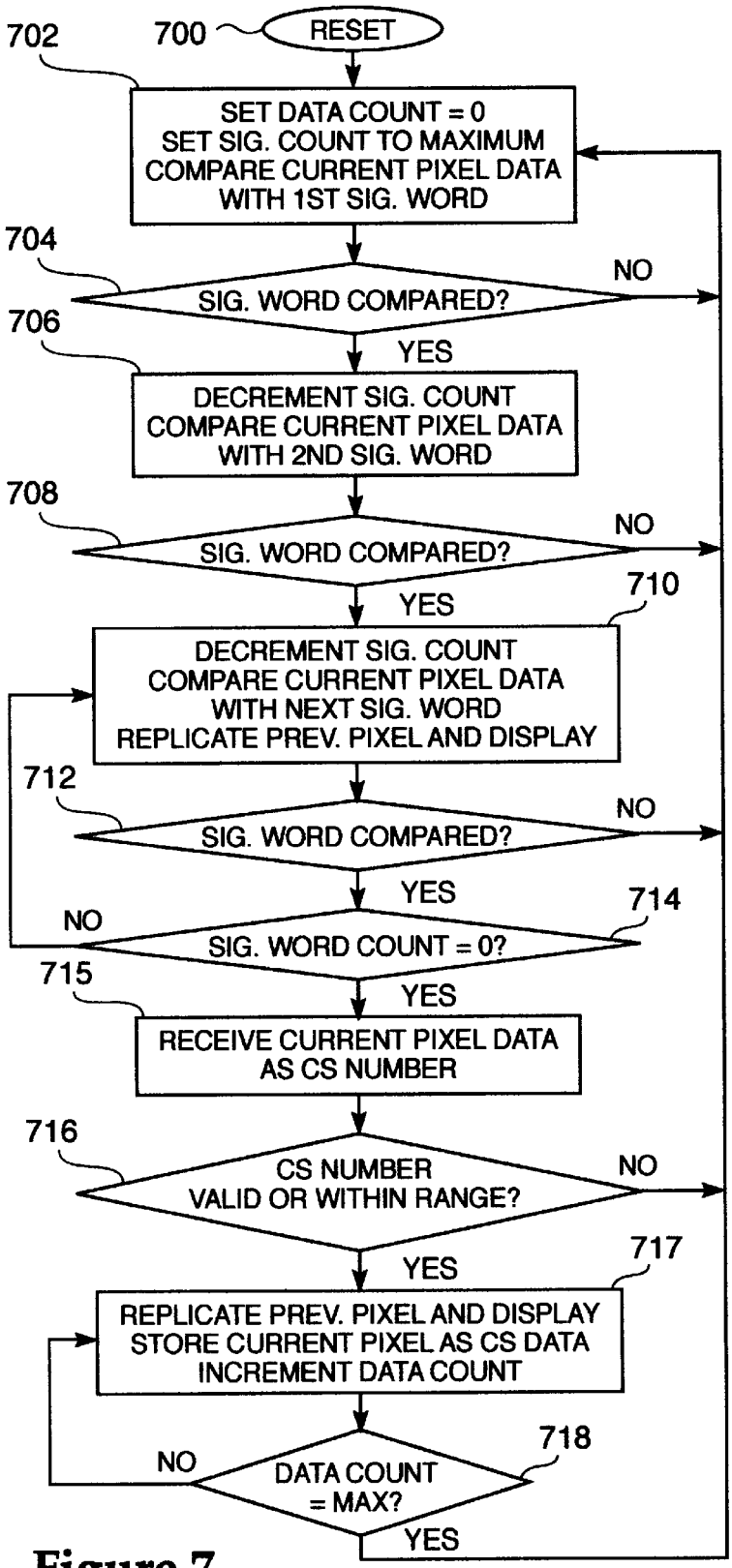
FIG. 7 shows a flow chart of the operation of the state machine/timing control logic of the present invention.

The following is a discussion of the operation of a portion of the state machine/timing control logic 608 (also referred to as state machine herein) within IDDC 468 with references to FIGS. 6A–6C and FIG. 7. FIG. 7 shows a flow chart illustrating the operation of the IDDC 468. When the state machine is transferred to an action block such as blocks 702, 706, 710, 715, and 717 then a new frame of data has been transferred from the graphics controller to the IDDC. Upon reset 700, the state machine is initialized and then started. At the action block 702 a control set word counter is set to zero, the signature word counter is set to a maximum, and the current pixel data is compared in comparator 604 with the first signature number sequence (24 or 8 bit) generated by the pseudo random number generator (PSRNG) 606 or stored signature sequence (SSS) 607. At the decision block 704, if the first signature word from the PSRNG or SSS matches the current pixel data, than the state machine is incremented and transferred to the action block 706. If at the decision block 704 there is no match then the state machine is transferred to the action block 702 and once again the control set word and signature counters are re-initialized.

At the action block 706, the signature word counter is decremented by an appropriate value and the pixel data from the possible signature word pixel location of the next frame is compared with the second signature number sequence generated by the pseudo-random number generator 606 or stored signature sequence 607 within comparator 604. At the decision block 708, if this second number sequence matches the transmitted signature word substituted for the pixel image data, then the state machine is transferred to the action block 710. In this case two matches have occurred and in the next frame the replication of the previous pixel for the substituted pixel will begin. Otherwise if there is no second match the state machine is transferred to the action block 702.

At the action block 710, the signature word counter is decremented by an appropriate value and the pixel data from the possible signature location of the next frame is compared with the third signature number sequence generated by the pseudo-random number generator 606 or the stored signature sequence 607 within the comparator 604. Also at the block 710, the replication process starts after two signature words have been matched. The previous pixel within the same frame of the substituted pixel is replicated for the pixel that may contain the third signature word. Thus during this frame one pixel will be displayed twice on the screen. It is conceivable that more than one pixel could be replicated within a given frame in the case that more that one pixel of control set word or signature word is transmitted per frame. At decision block 712 if the third number sequence matches the transmitted signature word then the state machine is transferred to decision block 714. Otherwise if there is no match of the third signature word, the state machine is transferred back to action block 702.

At decision block 714 the state machine is transferred to action block 715 if the signature counter has been decremented to zero. Otherwise the state machine loops back to action block 710 where further comparisons are made with the remaining signature sequence for other frames. Once again the signature counter is decremented by an appropriate value. The pixel data from the possible signature word location of the next frame is compared by comparator 604, with the next signature number sequence generated by the pseudo-random number generator 606 or stored signature sequence 607. As before, the previous pixel within the same frame of the substituted pixel is replicated for the pixel that may contain further signature words. At decision block 712, if the present signature number sequence matches the transmitted pixel data then the state machine is transferred to decision block 714. Otherwise the state machine is transferred back to action block 702.

At decision block 714 the state machine is transferred to action block 715 if the signature counter has been decremented to zero. Otherwise the state machine loops back to action block 710 and continues as described in the previous paragraph. Assuming the signature counter has reached zero and the complete signature sequence of signature words has been matched, the operation of the state machine in receiving control set words will now be described.

At action block 715, the frame following the signature sequence has a pixel location containing data representing one of a plurality of Control Set Numbers (CS Number). The current pixel data in the proper pixel location transmitted by the graphics controller and received by the IDDC is compared with the expected number or range of numbers by the random logic 674. In the example above, a control set number of 0 represented a default value, the range of control set numbers 1,2 represented a forced value for a control set number, and numbers 3–7 representing the desired values for a control set number. The default and forced values for the control set number are always received by the IDDC.

The desired values for control set number may or may not be received by the IDDC. The IDDC may receive the various indicia from the Sensors 248 to determine if this is a desired control set.

At the decision block 716 the state machine determines whether the CS number representing the following control set is one the IDDC is looking for or whether it is one that must be received. If the CS number is outside the entire range of either the default, forced, or desired values of possible CS numbers than the state machine is transferred back to the action block 702. If the CS number is within the range of desired values of CS numbers and it is not a CS number that the IDDC desires than the state machine is transferred back to the action block 702. Otherwise, if the CS number is a default or forced value of control set number or a desired value of control set number that matches that which is desired by the IDDC, then the state machine proceeds to the block 717.

At action block 717 the previous pixel within the given frame is replicated into the current pixel position containing a control set word. The current data which represents a portion of the control set is stored within the control set storage 470. The control set word counter is incremented by an appropriate value from an initial setting which was zero. At decision block 718, the control set word counter is compared with the maximum number of control set data bytes expected. If the control set word counter has not reached its maximum value than the state machine is transferred to action block 716 for the next frame containing a control set word. Otherwise the state machine is transferred back to action block 702 because the IDDC 468 has completely read the control set transferred by CPU 122 through graphics controller 126.

In the case that control set word counter has not reached its maximum value we are once again at action block 716. The previous pixel within the given frame is replicated into the current pixel position containing control set word. The current pixel data which represents a portion of the control set is stored within the control set storage 470. The control set word counter is incremented by an appropriate value. Again at decision block 718, the control set word counter is compared with the maximum number of control set data bytes expected. If the control set word counter has not reached its maximum value than the state machine is transferred back to action block 716 for the next frame containing a control set word. This process repeats itself until the control set word counter has reached it maximum value such that the state machine goes back to action block 702 waiting to detect the next time that the signature word is transmitted by the CPU.

It should be obvious to one of ordinary skill in the art that other initial settings may be used in the counters to count from and other counter values may be selected to generate the necessary control values. Further it should be obvious that the counters could either decrement or increment from initial values.

It should be obvious to one of ordinary skill in the art that the circuits described in the figures could be modified to accommodate other pixel data bus widths such as 3, 4, 6, 8, 9, 12, 15, 16, 18, 24 or other multiples thereof as the case may be.

The present invention has been described relative to a preferred embodiment and several alternate embodiments. It will be apparent to one of ordinary skill in the art after reading the teachings of this patent document that further modifications can be made without departing from the spirit and scope of the invention as defined in the claims appended hereto.

What is claimed is:

1. A display system comprising:

a host processor, for generating display information and for generating a plurality of control set data for controlling a display device in response to a measured parameter;

a display controller, coupled to the host processor for receiving display information and for generating units of display data, the display controller including:

means for transferring units of display data from the display controller to a display device;

a replacing circuit coupled to the means for transferring, for automatically replacing units of display data with a plurality of sets of control data for transfer with the display data;

a display device, including:

a flat panel display, a display driver controller, for controlling operation of the flat panel display to display pixels on the display device represented by the display data, the display driver controller including:

a digital memory coupled to the display device for storing a selected control data set having a predetermined effect upon the image quality;

means for retrieving selected control data from the display data and modifying the control data set within the digital memory with the control data; and means for replicating at least one pixel corresponding to the at least one unit based on a value of a neighboring unit of display data within a single frame;

wherein the display driver controller further comprises:

at least one sensor for measuring a value of at least one parameter indicative of an operating condition of the display device, the at least one parameter having a predetermined effect upon quality of the image; and means for selecting one of the plurality of control sets as a function of the measured at least one parameter, wherein the display driver controller individually and automatically selects particular corrected color levels corresponding to the pre-corrected color levels from the selected control set.

2. A method of transferring control data to a display device during a display time while maintaining image quality, the method comprising the steps of:

sending a signature from a display controller to the display device during the display time as display data;

sending at least one control data set from a display controller as display data to the display device during the display time;

detecting, at the display device, the signature and control data set from within the display data;

storing, in the display device a control data set for use in controlling image quality of the display;

measuring, in the display device, a parameter of the display;

selecting, in the display device, a portion of the control data set to control image quality of the display in response to the measured parameter; and replacing the control data set portion of the display data by replicating at least one pixel data based on a value of neighboring pixel data within a single frame during the sending of control set data.

3. A computer system comprising:

a display device for displaying an image comprising a plurality of pixels, said display device including:

a display driver controller and column and row pixel drivers coupled to the display driver controller, the display device for displaying an image comprising a plurality of pixels, at least one sensor for measuring a value of at least one parameter indicative of an operating condition of the display device, the at least one parameter having a predetermined effect upon quality of the image, and a digital memory storing a plurality of control sets, each of the plurality of control sets corresponding to a particular value of the at least one parameter, each of the plurality of control sets including a plurality of corrected color levels, each of the plurality of corrected color levels being associated with a corresponding one of the plurality of possible color levels; and a display controller coupled by a set of signal lines to the display device, the signal lines configured to provide a plurality of precorrected color levels from the display controller to the display driver controller, each of the plurality of precorrected color levels indicating one of a plurality of possible color levels for a corresponding one of the plurality of pixels of the image;

wherein the display driver controller selects one of the plurality of control sets as a function of the measured at least one parameter, wherein the display driver controller individually and automatically selects particular corrected color levels corresponding to the precorrected color levels from the selected control set, and wherein the display driver controller transmits the selected corrected color levels to the column and row pixel drivers for displaying the image, each of the selected corrected color levels corresponding to a respective one of the plurality of pixels of the image.

4. The computer system according to claim 3, further comprising:

an interrupt signal line coupling the display controller to the display device, wherein an interrupt signal is transmitted to the display controller when a value of the at least one parameter changes by a predetermined threshold amount, and wherein the display driver controller selects one of the plurality of control sets only after the interrupt signal is transmitted.

5. The system according to claim 4, wherein the digital memory includes a random access memory coupled to the display device.

6. The system according to claim 3, wherein the display controller includes:

a graphics controller for controlling a process of providing the plurality of precorrected color levels from the display controller to the display driver controller, each of the plurality of precorrected color levels indicating one of the plurality of possible color levels for the corresponding one of the plurality of pixels of the image; and means for substituting at least one of the plurality of precorrected color levels for a corresponding one of the plurality of pixels of the image with control data, wherein the display driver controller selects one of the plurality of control sets as a further function of the control data.

7. The system according to claim 6, wherein the display driver controller substitutes the substituted at least one of the plurality of precorrected color levels for the corresponding one of the plurality of pixels with a precorrected color level of a particular one of the plurality of pixels adjacent the corresponding one of the plurality of pixels.

8. The system according to claim 3, wherein the control signal is coupled to the display device by a first and second set of signal cables, wherein the display controller provides image data over the first set of signal cables, wherein the display controller provides control data over the second set of control cables, and wherein the display driver controller selects one of the plurality of control sets as a further function of the control data.

9. The system according to claim 3, wherein the digital memory is coupled to the display driver controller.

10. The system according to claim 3, wherein the digital memory includes a nonvolatile memory.

11. The system according to claim 3, wherein the digital memory includes a volatile memory.

12. The system according to claim 3, wherein the color levels include a first level of red, a second level of green, and a third level of blue.

13. The system according to claim 3, wherein the display controller is physically separated from the display device.

14. The system according to claim 3, wherein the at least one sensor measures an operating temperature.

15. The system according to claim 3, wherein the at least one sensor measures a display voltage linearity.

16. The system according to claim 3, wherein the at least one sensor measures a power supply voltage.

17. The system according to claim 3, wherein the display device is a monitor, and the at least one sensor is mounted to the monitor.

18. The system according to claim 3, wherein the least one sensor is connected to the display controller.

19. A method for maintaining a quality of an image displayed on a display device having a display driver controller and column and row pixel drivers coupled to the display driver controller, the method comprising the steps of:

measuring in the display device, a value of at least one parameter indicative of an operating condition of the display device, the at least one parameter having a predetermined effect upon the quality of the image;

providing a plurality of precorrected color levels from a display controller over a set of signal lines to the display driver controller, each of the plurality of precorrected color levels indicating one of a plurality of possible color levels for a corresponding one of a plurality of pixels of the image;

storing a plurality of control sets within the display driver controller, each of the plurality of control sets corresponding to a particular value of the at least one parameter, each of the plurality of control sets including a plurality of corrected color levels, each of the plurality of corrected color levels being associated with a corresponding one of the plurality of possible color levels;

selecting one of the plurality of control sets as a function of the measured at least one parameter;

individually and automatically selecting particular corrected color levels corresponding to the precorrected color levels from the selected control set;

transmitting the selected corrected color levels to the column and row pixel drivers for displaying the image, each of the selected corrected color levels corresponding to a respective one of the plurality of pixels of the image; and displaying each of the selected corrected color levels corresponding to the respective one of the plurality of pixels of the image.

* * * * *